US008561807B2

(12) United States Patent
Ross

(10) Patent No.: US 8,561,807 B2
(45) Date of Patent: Oct. 22, 2013

(54) MAGNETIC DRUM SEPARATOR WITH AN ELECTROMAGNETIC PICKUP MAGNET HAVING A CORE IN A TAPERED SHAPE

(75) Inventor: Michael John Ross, Waterford, PA (US)

(73) Assignee: Eriez Manufacturing Co., Erie, PA (US)

( * ) Notice: Subject to any disclaimer, the term of this patent is extended or adjusted under 35 U.S.C. 154(b) by 0 days.

(21) Appl. No.: 13/462,886

(22) Filed: May 3, 2012

(65) Prior Publication Data

US 2013/0146510 A1 Jun. 13, 2013

Related U.S. Application Data

(60) Provisional application No. 61/568,991, filed on Dec. 9, 2011.

(51) Int. Cl.
*B03C 1/00* (2006.01)

(52) U.S. Cl.
USPC ..... 209/636; 209/212; 209/215; 209/224

(58) Field of Classification Search
USPC ..... 209/636, 212, 213, 215, 223.1, 224
See application file for complete search history.

(56) References Cited

U.S. PATENT DOCUMENTS

| | | | | |
|---|---|---|---|---|
| 1,105,293 | A | 7/1914 | Nathorst | |
| 1,366,979 | A | 2/1921 | Ullrich | |
| 1,729,008 | A * | 9/1929 | Osborne et al. | 209/223.2 |
| 2,081,445 | A | 5/1937 | Andrews et al. | 209/219 |
| 2,950,008 | A | 8/1960 | Buus | 209/219 |
| 3,426,897 | A | 2/1969 | Salmi | 209/223 |
| 3,552,565 | A | 1/1971 | Fritz | 209/219 |
| 3,892,658 | A | 7/1975 | Benowitz | 209/213 |
| 4,051,023 | A | 9/1977 | Fogle et al. | 209/223 |
| 4,874,508 | A * | 10/1989 | Fritz | 209/214 |
| 7,681,813 | B2 | 3/2010 | Goldmann | 241/24.14 |
| 7,886,913 | B1 * | 2/2011 | Fritz et al. | 209/224 |
| 7,918,345 | B2 | 4/2011 | Molteni | 209/215 |
| 2002/0134708 | A1 * | 9/2002 | Ohkawa | 209/214 |
| 2011/0163015 | A1 | 7/2011 | Shuttleworth et al. | 209/223.2 |

FOREIGN PATENT DOCUMENTS

| | | |
|---|---|---|
| DE | 2007 529 | 9/1971 |
| GB | 1913 12368 | 12/1913 |
| GB | 100064 | 3/1916 |
| GB | 152549 | 10/1920 |
| GB | 208835 | 1/1924 |
| GB | 1555793 | 11/1979 |

* cited by examiner

*Primary Examiner* — David H Bollinger
(74) *Attorney, Agent, or Firm* — Jonathan M. D'Silva; MacDonald, Illig, Jones & Britton LLP

(57) ABSTRACT

A magnetic drum separator, for separating ferrous and non-ferrous materials from a material stream. The magnetic drum separator comprising an outer shell that is rotatable around a central axis by a drive mechanism. The outer shell having a tubular length parallel to the central axis and a circular cross-section perpendicular to the central axis. An electromagnet pickup magnet positioned at a fixed location within the circular cross-section has a cross-section perpendicular to the central axis. The pickup magnet has a first end closest to the inner circumference of the outer shell and a second end located near the central axis. The pickup magnet comprises a core, with a backbar abutting it at the second end. The core comprises a plurality of blocks of different widths, in a cross-section perpendicular to the central axis, with the narrowest block at the first end and the widest block abutting the backbar.

18 Claims, 19 Drawing Sheets

MAGNETIC DRUM SEPARATOR WITH AN ELECTROMAGNETIC PICKUP MAGNET HAVING A CORE IN A TAPERED SHAPE

This application takes priority from U.S. Provisional Patent Application 61/568,991 filed on Dec. 9, 2011, which is incorporated herein by reference.

BACKGROUND

Magnetic drum separators are commonly used in recycling, municipal solid waste, wood waste, slag, incinerator bottom ash, foundry sand, and in mineral processing applications. Typically, these magnetic drum separators have a magnetic element that is used to sort material streams that comprise of both ferrous and non-ferrous scrap by extracting the ferrous scrap from the material stream. These magnetic drum separators are typically located immediately downstream of shredders and/or grinders that break up non-ferrous scrap that is not extracted into more manageable pieces for sorting and separating. What is presented is an improved magnetic drum separator for pulling ferrous scrap from a material stream.

SUMMARY

A magnetic drum separator for the separation of ferrous and non-ferrous materials from a material stream comprising an outer shell that is rotatable around a central axis by a drive mechanism. The outer shell has a tubular length and a circular cross-section. The tubular length is parallel to the central axis and the circular cross-section is perpendicular to the central axis. A pickup magnet that is an electromagnet is positioned at a fixed location within the outer shell, extends along the tubular length, and has a cross-section that is perpendicular to the central axis in which a first end is closest to the inner circumference of the circular cross-section and a second end is located near the central axis. The pickup magnet comprises a core, at least one electrical wire wrapped around the core, and a backbar abutting the core at the second end. The core comprises a plurality of blocks, each block of different widths in a cross-section perpendicular to the central axis. The narrowest of the blocks is at the first end and the widest of the blocks abuts the backbar such that the core has a cross-section perpendicular to the central axis that is an incrementally stepped tapered shape. The pickup magnet is powerful enough to produce a magnetic field suitable for separating ferrous materials from non-ferrous material in the material stream.

Some embodiments of the magnetic drum separator have a carry magnet that is positioned at a fixed location within the outer shell, near the inner circumference of the circular cross-section and downstream of the pick-up magnet in the direction of rotation of the outer shell. Additionally, the magnetic drum separator can have each of the blocks wrapped by at least one electrical wire to form an independent circuit. The magnetic drum separator can also have an interpole magnet positioned at a fixed location between the pickup magnet and the carry magnet. The magnetic drum separator can also have a core that has a cross-section perpendicular to the central axis that is in three step increments. The magnetic drum separator can also have a pickup magnet that further comprises a nosepiece that abuts the core at the first end. The magnetic drum separator could have a core that further comprises a backbar with a cross-section perpendicular to the central axis that is in a stepped shape. The magnetic drum separator could have a core that comprises a single block that has a tapered cross-section perpendicular to the central axis that is narrowest at the first end and widest where the core abuts the backbar.

Other embodiments of the magnetic drum separator have a core that comprises a front block, a middle block, and a back block. Each block has a different width in a cross-section that is perpendicular to the central axis, such that the core has a cross-section perpendicular to the central axis that is an incrementally stepped tapered shape and each block is a different length in the cross-section parallel to the central axis. The front block is the narrowest of the blocks, located at said first end, and is longer than the back block. The back block is the widest of the blocks, abuts against the backbar, and is longer than the middle block.

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

BRIEF DESCRIPTION OF DRAWINGS

For a more complete understanding and appreciation of this invention, and its many advantages, reference will be made to the following detailed description taken in conjunction with the accompanying drawings.

DETAILED DESCRIPTION

Figure 1:
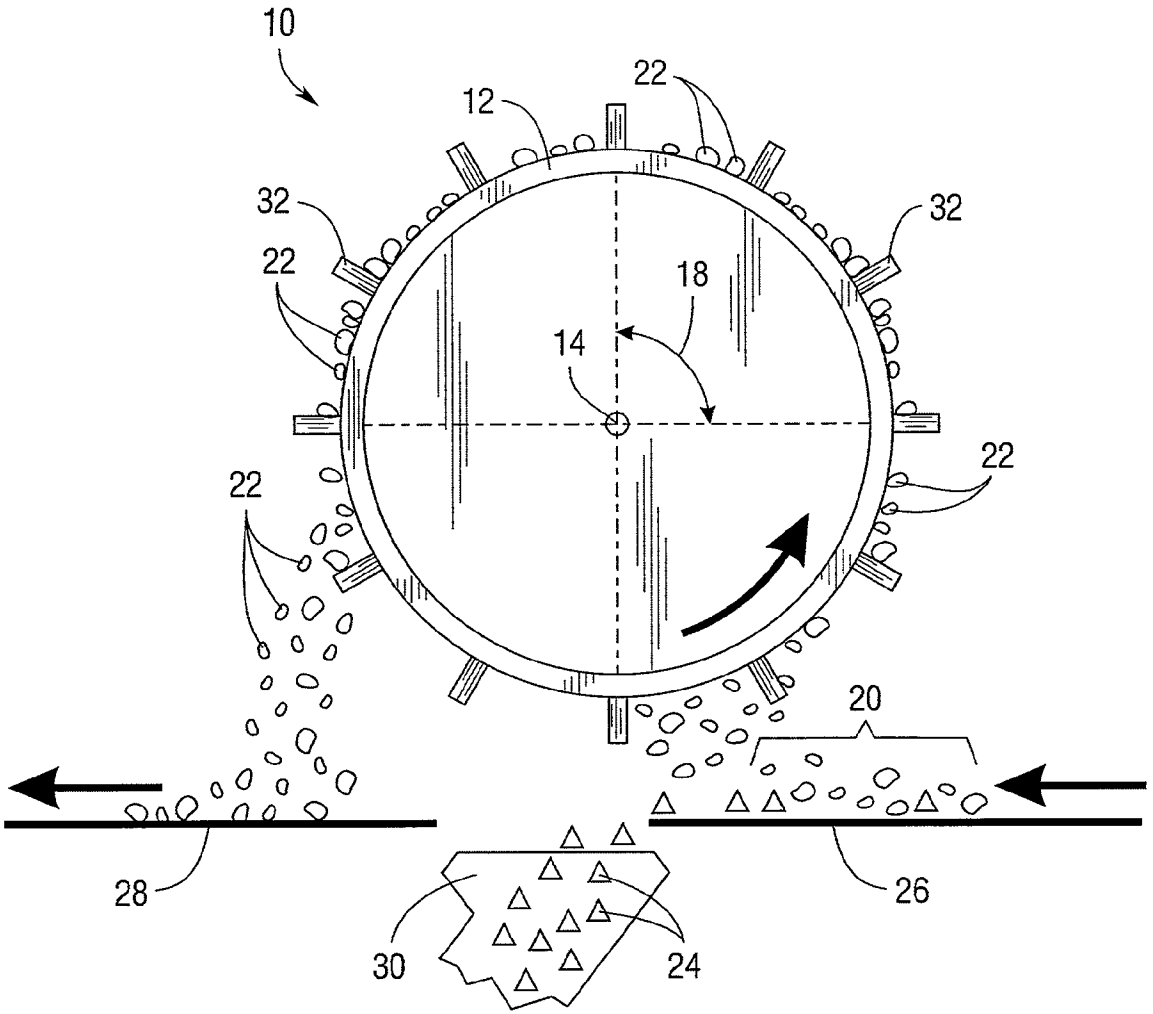
FIG. 1 depicts a magnetic drum separator in operation.

Referring to the drawings, some of the reference numerals are used to designate the same or corresponding parts through several of the embodiments and figures shown and described. Corresponding parts are denoted in different embodiments with the addition of lowercase letters. Variations of corresponding parts in form or function that are depicted in the figures are described. It will be understood that variations in the embodiments can generally be interchanged without deviating from the invention.

What is proposed is a new and improved magnetic drum separator for the separation of ferrous material and non-ferrous materials from a material stream where the internal components of the magnetic drum separator take up less space, weigh less, use less material to manufacture, and are generally more efficient.

Figure 2:
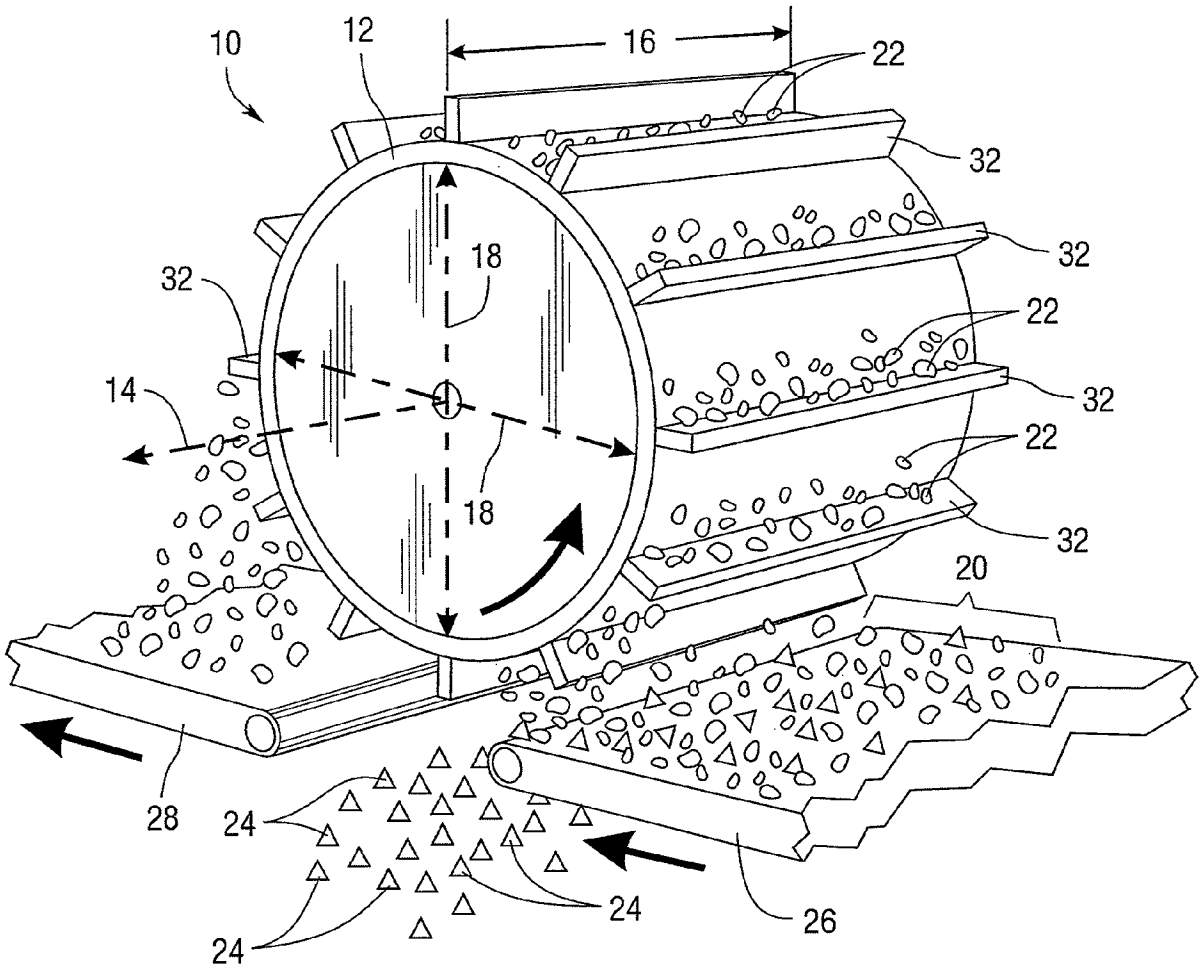
FIG. 2 shows a perspective view of the drum separator FIG. 1.

Magnetic drum separator systems typically process several hundred tons of raw materials a day and even several hundred tons per hour depending on the size of the facility and the size of the equipment being used. As shown in FIGS. 1 and 2, magnetic drum separators 10 consist of an outer shell 12 that is rotatable around a central axis 14 by a drive mechanism (not shown) in the direction indicated in the figures and around a number of parts (discussed in more detail later) housed within the outer shell 12. The outer shell 12 has a tubular length 16 and a circular cross section 18 that is centered around the central axis 14. The tubular length is parallel to the central axis 14 and the circular cross-section 18 is perpendicular to the central axis 14. The outer shell 12 is available in a variety of dimensions, but generally the tubular length 16 ranges from 48 to 108 inches and the cross-section 18 can have diameters of 36 to 72 inches.

The material stream 20 to be sorted comprises a mixture of ferrous 22 and non-ferrous 24 materials. The material stream 20 is passed under the drum separator 10 using any appropriate first transfer system 26 such as conveyors, chutes, vibrators, etc. while the outer shell 12 rotates. As will be described later, the ferrous 22 material is magnetically attracted to the drum separator 10 and becomes magnetically attached to the surface of the outer shell 12. As the outer shell 12 rotates, the magnetically attached ferrous 22 material is rotated around the magnetic drum separator 10 until the ferrous 22 material passes out of the magnetic field generated within the magnetic drum separator 10 and falls off the outer shell 12 on the far side of the material stream 20 onto a second transfer system 28. The non-ferrous 24 material of the material stream 20 that is not attracted to the outer shell 12 falls off the first transfer system 26 into a chute 30 or other means for disposal or further processing.

The outer shell 12 of the magnetic drum separator 10 could comprise a series of cleats 32 that assist the movement of the ferrous 22 material on the outer shell 12 of the magnetic drum separator 10.

The internal workings of the magnetic drum separator 10 are at the heart of what makes the system work. Magnetic fields are generated by a series of magnets that are directed towards the first transfer system 26 to pull the ferrous 22 fraction from the material stream 20 and then to hold the ferrous 22 material onto the outer shell 12 as it rotates. The ferrous 22 material is carried around the outer shell 12 and deposited onto the second transfer system 28.

Figure 3:
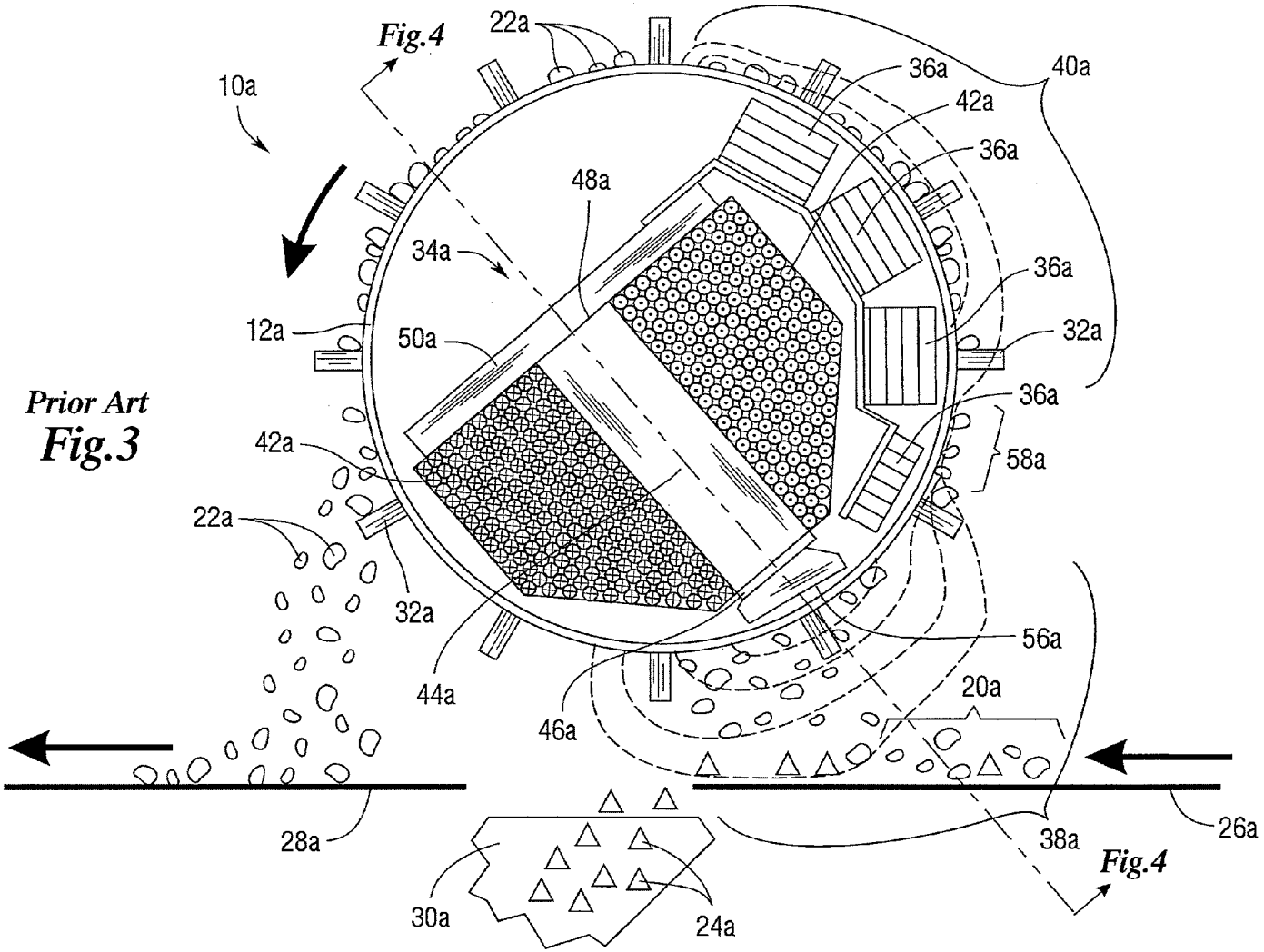
Prior Art Fig.3
FIG. 3 depicts a cross-section of a prior art embodiment of a magnetic drum separator in operation.
Figure 4:
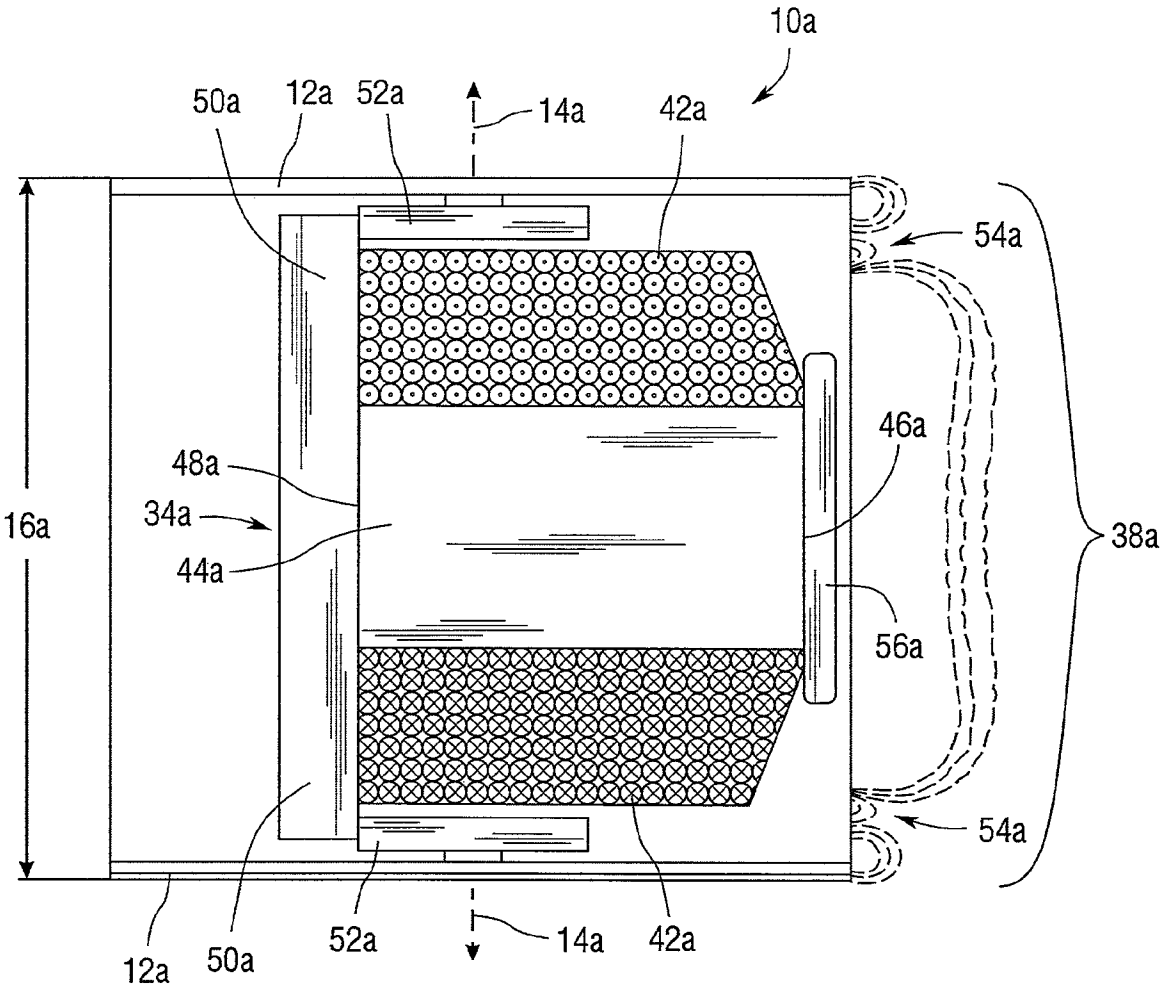
Prior Art Fig.4
FIG. 4 shows an overhead cross-section view of the prior art embodiment shown in FIG. 3.

FIGS. 3 and 4 show a prior art magnetic drum separator 10*a* showing the internal mechanisms used for the separation process. The primary magnet used to separate the ferrous 22*a* fraction of the material stream 20*a* from the non-ferrous 24*a* fraction is called a pickup magnet 34*a*. Once the ferrous 22*a* fraction of the material stream 20*a* is attached to the outer shell 12*a*, a series of smaller magnets called carry magnets 36*a* help keep the ferrous 22*a* material on the outer shell 12*a* at least until the ferrous 22*a* material reaches the top of the magnetic drum separator 10*a* after which there is no further reason to keep the ferrous 22*a* material on the outer shell 12*a* and the ferrous 22*a* material is allowed to drop off by gravity onto the second transfer system 28*a*.

For purposes of illustration, the magnetic fields generated by the pickup magnet 34*a* and the carry magnets 36*a* are depicted as dashed lines emanating from the rotating outer shell 12*a*. The pickup magnet 34*a* is positioned and oriented such that the magnetic field 38*a* it generates is directed towards the material stream 22*a* on the first transfer system 26*a*. The carry magnets 36*a* are positioned above the pickup magnet 34*a* so that its magnetic field 40*a* continues to attract the ferrous 22*a* material to the outer shell 12*a*.

With some exceptions, the pickup magnets 34*a* are typically electromagnets which are normally created by wrapping an electrical wire 42*a* around a core 44*a*. The core 44*a* is typically made of some kind of ferrous material. Passing an electrical charge from a power supply (not shown) through the electrical wire 42*a* creates a magnetic field 38*a* as depicted by dotted lines in FIG. 3. Through the properties associated with the ferrous core 44*a*, the passage of electric current through the electrical wire 42*a*, and around ferrous core 44*a*, generates a corresponding magnetic field 38*a*. The electrical wire 42*a* is typically made of copper or aluminum. The strength of the magnetic field 38*a* varies with the amount of current passed through the electrical wire 42*a*, the number of windings that the electrical wire 42*a* is wrapped around the core 44*a*, the type of ferrous material that makes up the core 44*a*, and the size and shape of the core 44*a* itself.

There is a direct correlation between the number of times electrical wire is wound around a core and the strength of the magnetic field that is generated from an electromagnet. The number of windings versus the strength of the magnetic field can be represented by the following equation:

$$NI=B_0 \cdot g \cdot 2.0195 \cdot (1+SF)$$

Where N is the number of windings of the electrical wire, I is the amperage flowing through the electrical wire (NI are measured in "ampere-turns" where turns refers to the number of windings of an electrical wire), $B_0$ is the flux density of the air gap measured in gauss, g is the air gap measured in inches, and SF is the safety factor. The safety factor is generally added in at 5-10% to ensure a more accurate calculation. This equation is generally used for closed systems that are unlike the open loop systems found in magnetic drum separators. However, the effects of the magnetic fields generated by pickup magnets in magnetic drum separators begin to act like a closed loop system when the ferrous material of the core is magnetically saturated. As can be from the above equation, the flux density, $B_0$, that is generated is directly related to the number of windings of the electrical wire in that the greater number of windings, the stronger the magnetic field.

An advantage of using electromagnets as pickup magnets 34*a* is that the magnetic field 38*a* can be manipulated by controlling the amount of current flowing through the electrical wire 42*a*. Moreover, the magnetic field 38*a* can be shut down altogether by turning off the current. This makes cleaning the outer shell 12*a* simpler and allows for safer routine maintenance when the magnetic drum separator 10*a* is not in use.

In the prior art embodiment shown in FIGS. 3 and 4, the pickup magnet 34*a* comprises a single elongated rectangular core 44*a* with electrical wire 42*a* wrapped around the core 44*a* to a thickness of about 12 to 16 inches on each side of the core 44*a*. The pickup magnet 34*a* comprises a first end 46*a* and a second end 48*a*. The first end 46*a* is closest to the inner circumference of the circular cross-section 18*a* and the second end 48*a* is located closer to the central axis 14*a*. A backbar 50*a* abuts against the second end 48*a* of the pickup magnet 34*a*. The backbar 50*a* is typically made from the same ferrous material as the core 44*a* and provides additional mass to support the entire pickup magnet 34*a*. The backbar 50*a* also creates a backstop for the core 44*a* to push up against and also physically supports the core 44*a*.

In order to get the pickup magnet 34*a* as close to the inner circumference of the circular cross-section 18*a* as possible and within the confines of the outer shell 12*a*, the pickup magnet 34*a* is constructed so that fewer wrappings of electrical wire 42*a* are used around the first end 46*a* giving the electrical wire 42*a* a slightly tapered shape. This limitation means that there are fewer windings of the electrical wire 42*a* around the first end 46*a* of the core 40*a* which has a negative effect on the strength of the magnetic field 38*a* generated by the pickup magnet 34*a*. Moreover, because of the uneven number of windings across the length of the core 44*a*, it is common for the electrical wire 42*a* to unravel during construction when a pickup magnet 34*a* is inserted into the outer shell 12*a*.

Furthermore, the pickup magnet 34*a* has hardware that holds it in place within the magnetic drum separator 12*a* which takes up additional space. In the embodiment of the prior art shown in FIG. 4, the pickup magnet 34*a* is mounted to the magnetic drum separator 12*a* by a pivot point 52*a* that is typically a weight bearing axle joined to the backbar 50*a*, configured to position the pickup magnet 34*a* within the magnetic drum separator 12*a*. The pivot point 52*a* runs through the central axis of rotation 14*a* of the magnetic drum separator 12*a*.

The orientation of tapered electrical wire 42*a* in conjunction with the pivot point 52*a* means that, the pickup magnet 34*a* does not actually extend across the entire tubular length 16*a* of the magnetic drum separator 10*a*. This creates dead zones 54*a* where the magnetic field 38*a* generated by the pickup magnet 34*a* has limited to no effect and that ferrous 22*a* material within this area will not be attracted to the outer shell 12*a*. This means that any first transfer system 26*a* must be sized to fit within this limited magnetic field 42*a* and represents lost sorting capacity in the entire system.

The second set of magnets in the magnetic drum separator 10*a* are the carry magnets 36*a* that are positioned at a fixed location, near the inner circumference of the circular cross-section 18*a*, and downstream of the pickup magnets 34*a* in the direction of the rotation of the outer shell 12*a*. The primary purpose of the carry magnets 36*a* is to hold the already separated ferrous 22*a* materials onto the outer surface of the outer shell 12*a* and therefore they do not have to be as powerful as the pickup magnets 34*a*. As seen in FIG. 3, the carry magnets 36*a* do so by extending the magnetic field 40*a* at least around the arc of the surface of the outer shell 12*a* in which the ferrous 22*a* material would be prone to fall back onto the material stream 20*a*. The carry magnets 34*a* are typically permanent magnets. Permanent magnets are objects made from material that is magnetized to create a persistent magnetic field that cannot be turned off like the magnetic field of an electromagnet.

The carry magnets 36*a* are oriented so that the ferrous 22*a* material extracted from the material stream 20*a* is able to hold on to the outer shell 12*a* after the ferrous 22*a* material has rotated past the portion of the magnetic field 42*a* generated by the pickup magnet 34*a*. The location of the carry magnets 36*a* limits where the pickup magnet 34*a* can be positioned, forcing either: 1) the pickup magnet 34*a* being located such that the first end 46*a* is further away from the inner circumference of the outer shell 12*a*; or 2) reduce the number of windings of the electrical wire 42*a* around the core 44*a*. In either case, the strength of the magnetic field 38*a* generated by the pickup magnet 34*a* is hindered which reduces the effectiveness of the magnetic drum separator 10*a*. In order to reduce the space between the first end 46*a* and the inner circumference of the circular cross-section 18*a*, a nosepiece 56*a* is attached to the core 44*a* at the first end 46*a*. This nosepiece 56*a* pushes the magnetic field 38*a* strength of the pickup magnet 34*a* toward the inner circumference of the circular cross-section 18*a*, but adds to the weight and production costs of the magnetic drum separator 10*a*.

The space limitations which determine the location of the internal mechanisms of the magnetic drum separator 10*a* often means that the transition area between the pickup magnet's 34*a* magnetic field 38*a* and the carry magnet's 36*a* magnetic field 40*a* is somewhat weaker. Areas of weakened magnetic field strength 58*a*, similar to the one on magnetic drum separator 10*a*, are generally referred to as a "drop zones." The magnetic field strength of the drop zone 58*a* is weak enough such that ferrous 22*a* material may continuously fall off the surface of the outer shell 12*a* and get caught again by the pickup magnet's 34*a* magnetic field 38*a*. This interaction will continue until the ferrous 20*a* material is either caught by the pick magnet's 36*a* magnetic field 40*a* or the ferrous 22*a* material falls off the drum separator 10*a* all together. Ultimately, the drop zone 58*a* keeps the drum separator 10*a* from reaching its full potential and leads to waste; costing time and resources; and reducing the overall lower quality drum separator.

Figure 5:
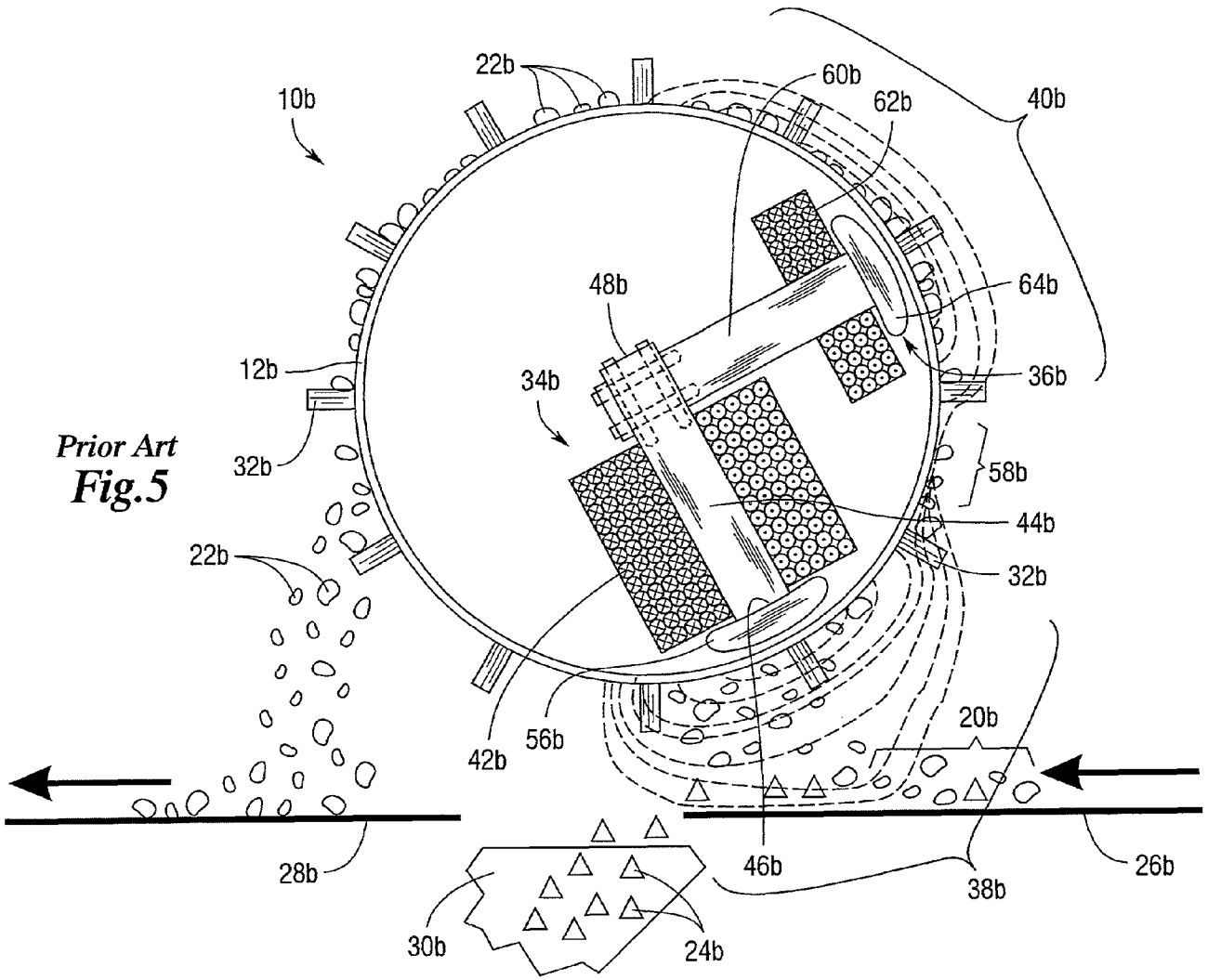
Prior Art Fig.5
FIG. 5 depicts a cross-section of a different prior art embodiment of a magnetic drum separator in operation.

As can be seen in FIG. 5, another prior art embodiment of a magnetic drum separator 10*b* incorporates a system in which the pickup magnet 34*b* and carry magnet 36*b* are both electromagnets. Because of the size and location of the carry magnet 36*b*, the electrical wire 42*b* of the pickup magnet 34*a* does not taper and therefore has a stronger magnetic field closer to the inner circumference of the cross-section 18*b*. This embodiment also includes a nosepiece 56*b* on the first end 46*b* of the core 44*b* that further extends the magnetic field 38*b* of the pickup magnet 34*b*. The carry magnet 36*b* sits perpendicular to the pickup magnet 34*b* and comprises a smaller core 60*b* with electrical wire 62*b* wrapped around its core 60*b*. In the embodiment shown in FIG. 5, the carry 36*b* magnet also has its own nosepiece 64*b*. As shown above, the strength of the magnetic field of an electromagnet is directly proportional to the number of winding of electrical wire around it. As the pickup magnet 34*b* must have a stronger magnetic field 38*b*, its electrical wire 42*b* is wrapped around its core 44*b* as much as possible and the carry magnet's 36*b* electrical wire 62*b* is only wrapped so that the carry magnet 36*b* is strong enough to hold ferrous material on the outer shell 12*b*. This arrangement suffers in that there is a substantial amount of unused space creating a large drop zone 58*b*, particular to this embodiment, that is between the magnetic field 38*b* of the pickup magnet 34*b* and the magnetic field 40*b* of the carry magnet 36*b*.

The limitations in the prior art magnetic drum separators are addressed in the preferred embodiment shown in FIGS. 6 through 11. The preferred embodiment comprises an outer shell 12*c* that is rotatable around a central axis 14*c* of rotation by a drive mechanism (not shown). The outer shell has a tubular length 16*c* and a circular cross section 18*c*. The tubular length 16*c* is parallel to the central axis 14*c* and the circular cross-section is perpendicular to the central axis 14*c*. The outer shell 12*c* houses the pickup magnet 34*c* and carry magnets 36*c* that comprise the magnetic drum separator 10*c*.

Figure 10:
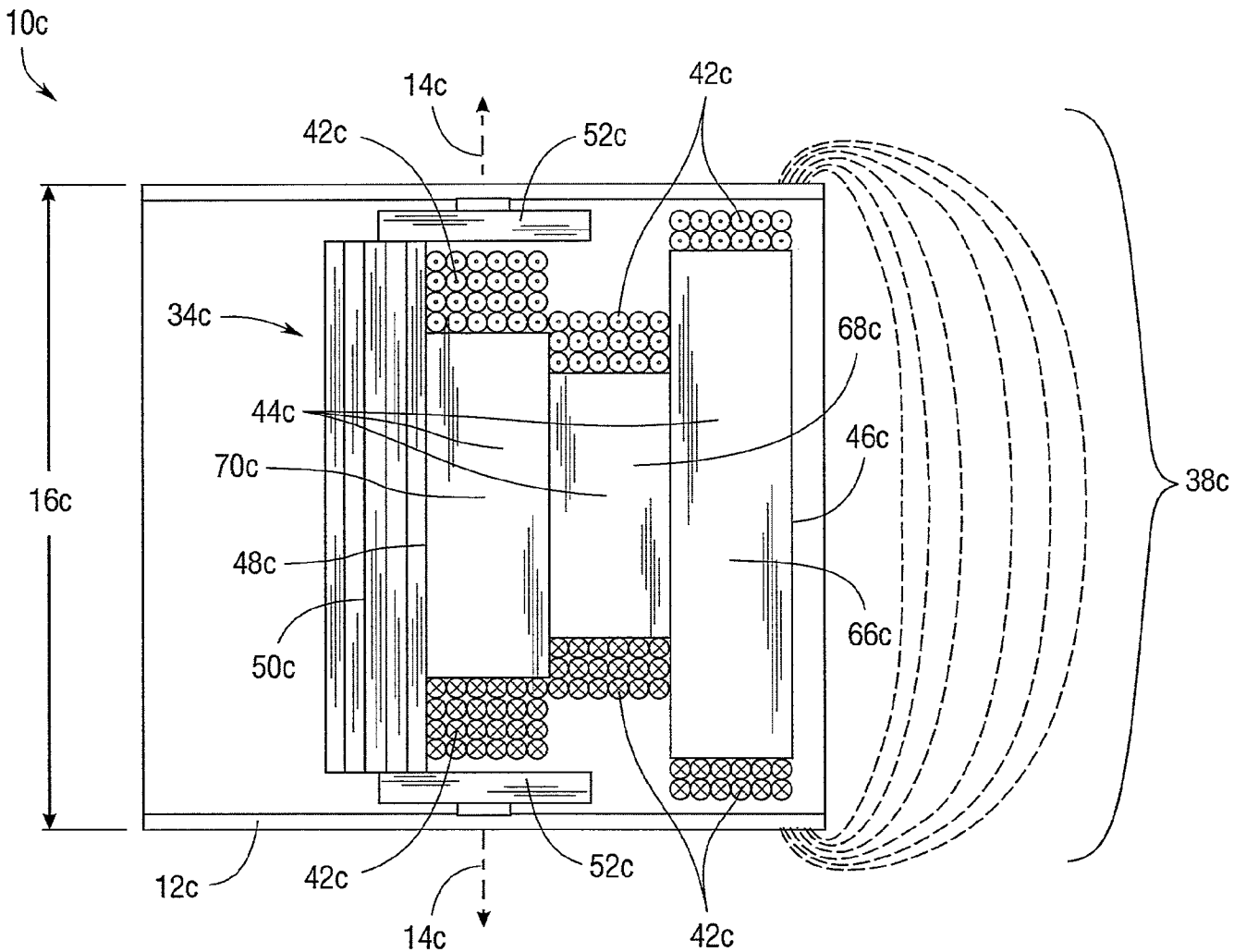
FIG. 10 is a cross-sectional overhead view of the magnetic drum separator of FIG. 6 showing a representation of the generated magnetic field.
Figure 11:
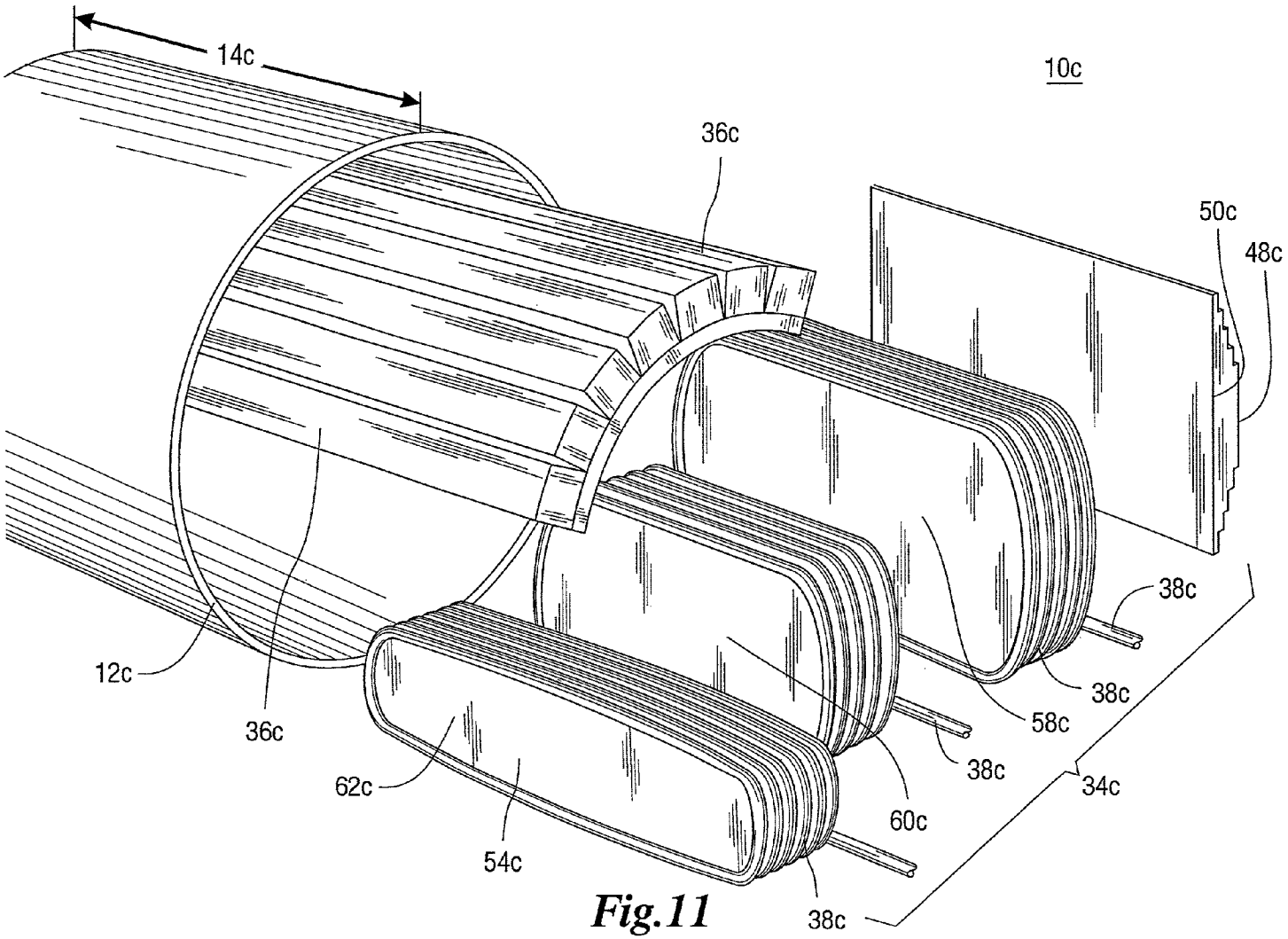
FIG. 11 is an exploded view of the magnetic drum separator FIG. 6.

The pickup magnet 34*c* is an electromagnet that is positioned at a fixed location within the outer shell 12*c*. The pickup magnet 34*c* comprises a core 44*c*, at least one electrical wire 42*c* wrapped around the core 44*c*, and a backbar 50*c*, abutting the core 46*c* at the second end. The pickup magnet 34*c* extends along the tubular length 16*c* of the outer shell 12*c* and has a cross-section perpendicular to the central axis 14*c* in which a first end 46*c* is closest to the inner circumference of the circular cross-section 18*c* and a second end 56*c* is located near the central axis 14*c*. As shown in FIG. 10, the pickup magnet 34*c* is held in place by a pivot point 52*c* that is typically a weight bearing axle affixed to the backbar 50*c*, configured to position the pickup magnet 34*c* correctly, and runs through the central axis 14*c* of rotation.

Figure 6:
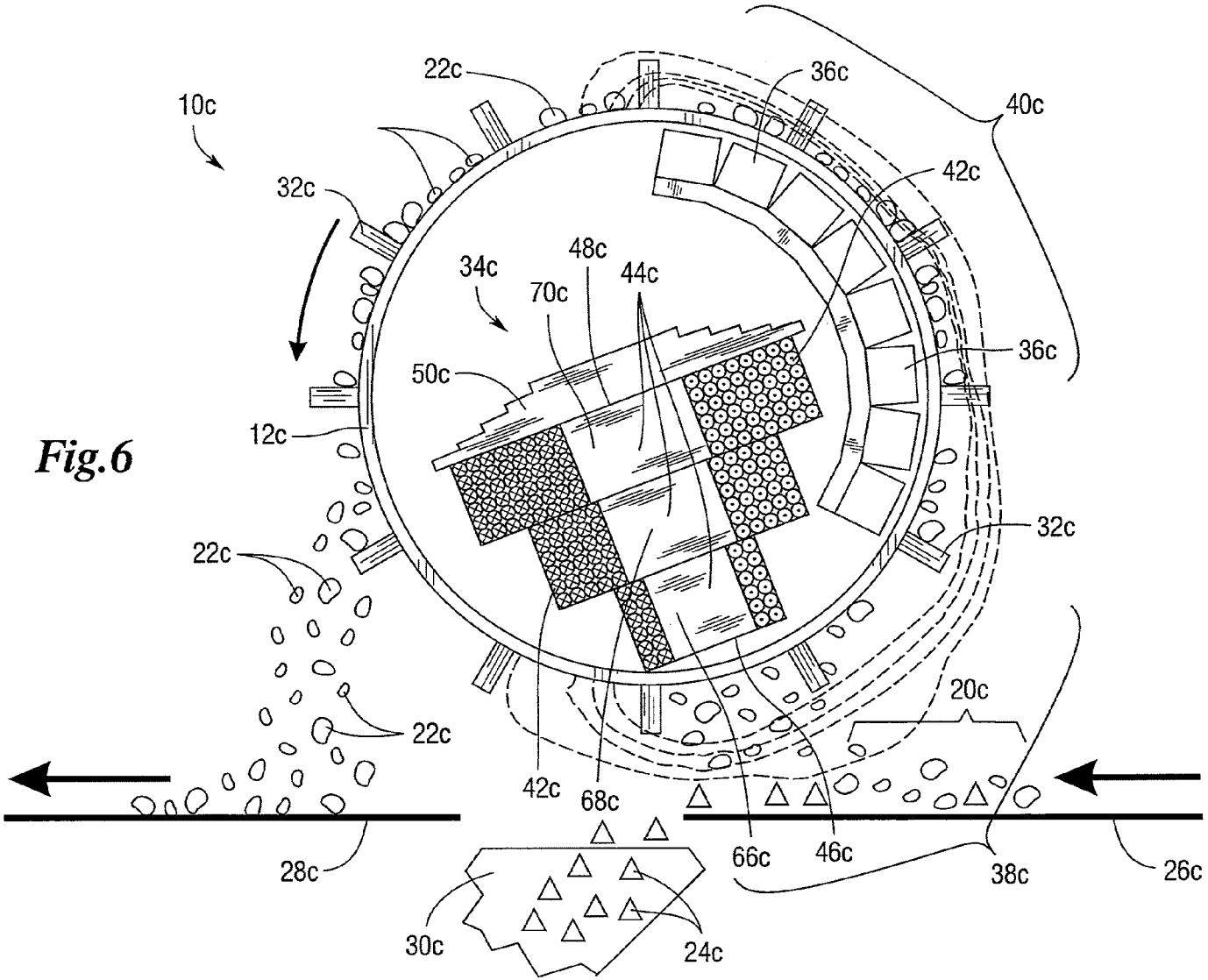
FIG. 6 is a cross-section view of the preferred embodiment of the magnetic drum separator in operation showing a representation of the generated magnetic field.

Referring to FIG. 6, since the pickup magnet 34*c* is the primary sorting tool of the magnetic drum separator 10*c*, the magnetic field 38*c* it generates is overall more powerful than the magnetic field 40*c* that is generated by the carry magnets 36*c*. The first end 46*c* of the pickup magnet 34*c* is the pole from which the magnetic field 38*c* is generated. The pickup magnet 34*c* is oriented to point the magnetic field 34*c* at the material stream 20*c* on the first transfer system 26*c*. The pickup magnet 34*c* is powerful enough to produce a magnetic field 38*c* suitable for separating ferrous 22*c* material from non-ferrous 26*c* material in the material stream 20*c*.

Figure 7:
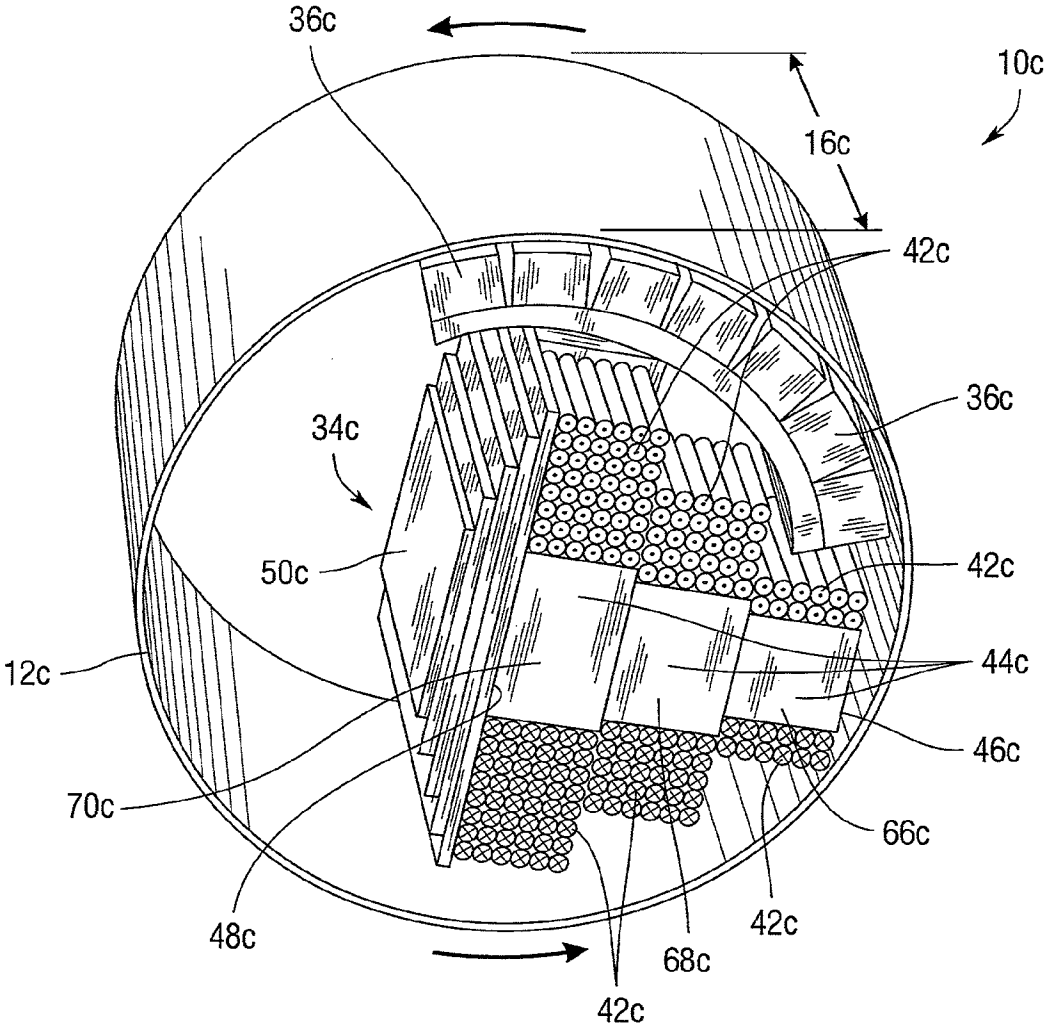
FIG. 7 shows a perspective view of the cross-section of the magnetic drum separator of FIG. 6.
Figure 8:
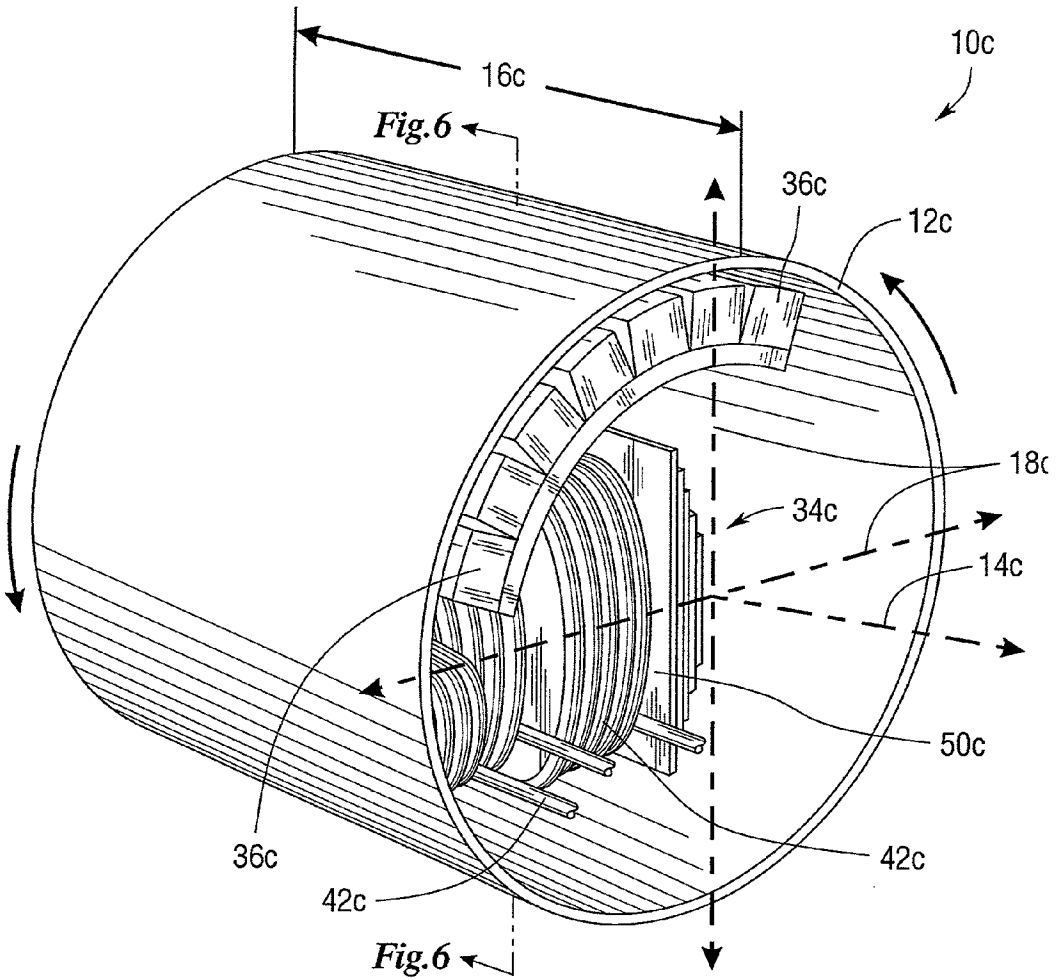
FIG. 8 shows a different perspective view of the cross section of the magnetic drum separator of FIG. 6.

As seen in FIGS. 6, 7, and 8, the core 44*c* comprises a front block 66*c*, a middle block 68*c*, and a back block 70*c*. Each block is of different widths in a cross-section perpendicular to the central axis 14*c* such that the core 44*c* has a cross-section perpendicular to the central axis 14*c* that is an incrementally stepped tapered shape. The front block 66*c*, the middle block 68*c*, and the back block 70*c* are each wrapped by an electrical wire 42*c* to form their own independent circuit.

Figure 9:
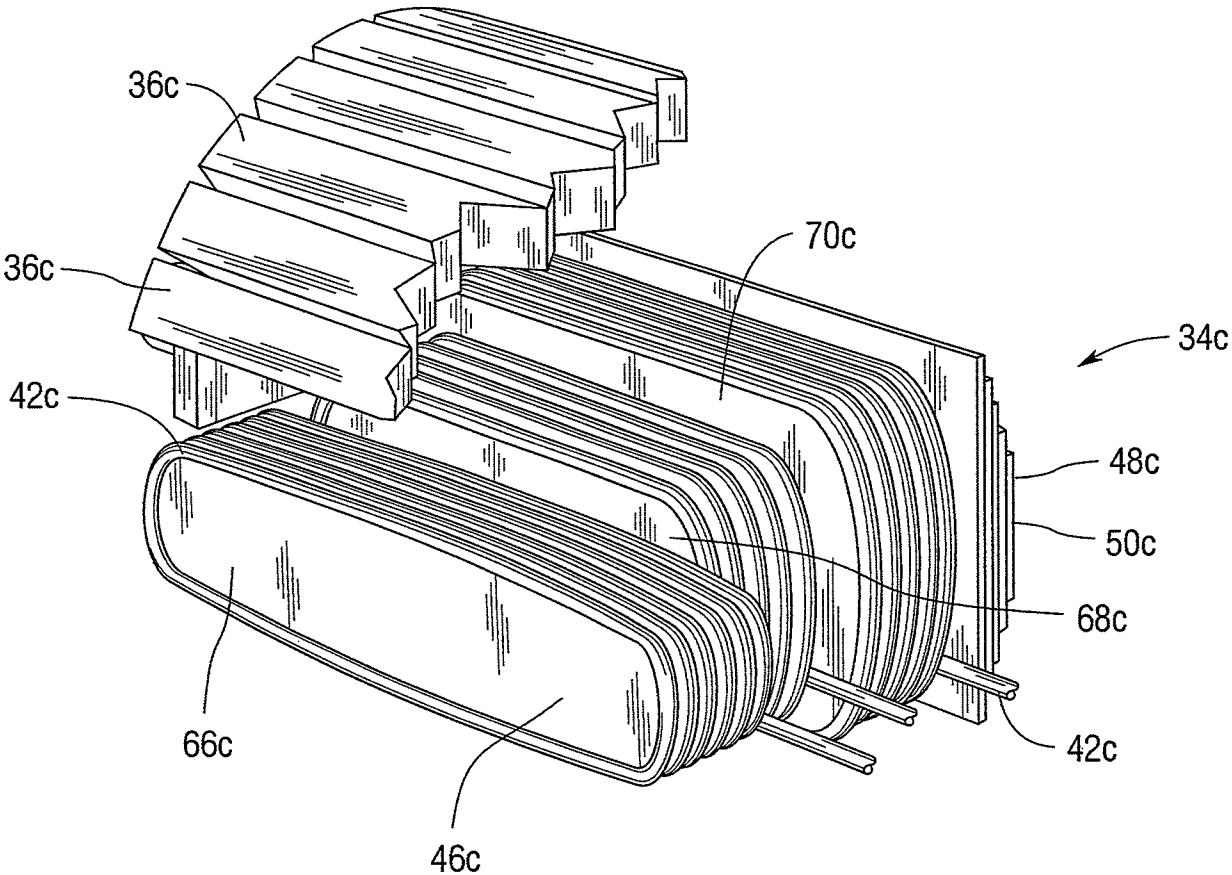
FIG. 9 is a perspective cut out view of some of the elements of the inner mechanisms of the magnetic drum separator FIG. 6.

Each block can be individually sized to maximize the available space within the rotating outer shell 12*c*. As can be seen in FIGS. 9 and 10, the front block 66*c*, the middle block 68*c*, and the back block 70*c* are of a different length in the cross-section parallel to the central axis 14*c*. The front block 66*c* is the narrowest of the blocks, located at the first end 46*c* and is longer than the back block 70*c*. The back block 70*c* is the widest of the blocks, abuts against the back bar 50*c*, and is longer than the middle block 68*c*. The location of the front block 66*c* is clear of the pivot point 52*c* which means that there is more room for a longer block and therefore the front block is sized to make the most use of the available space. In general the front block 66*c* is longer than the back block. Thus, the combination of the front block 66*c* and its electrical wire 42*c* take up as much of the tubular length 16*c* of the rotating outer shell 12*c* as possible. The middle block has a length that is shorter than both the lengths of the front block and the back block to save available space within the outer shell 12*c* as well as an additional benefit of reducing the weight of the pickup magnet 34*c*.

As can be seen in FIG. 10, this means that the magnetic field 38*c* created by the pickup magnet 34*c* in the preferred embodiment extends across the entire tubular length 16*c* of the outer shell 12*c*. This eliminates the dead zones along the outer edges of the outer shell seen in the prior art embodiments of magnetic drum separators.

Each of the blocks, the front block 66*c*, the middle block 68*c*, and the back block 70*c*, of the core 44*c* are made from a metallic ferrous material, such as soft iron or mild steel. In most cases the core 44*c* will be made from mild steel as opposed to stainless steel because mild steel is more ferrous in content. However, one skilled in the art would see that any ferrous material will be adequate for the core 44*c*. It may also be feasible to construct the blocks of the core 44*c* using non-ferrous material or non-metal blocks so long as the pickup magnet 34*c* is powerful enough to produce a magnetic field 38*c* suitable for separating ferrous 22*c* materials from non-ferrous 24*c* materials in the material stream 20*c*.

A backbar 50*c* is located at the second end 48*c* of the pickup magnet 34*c*. The backbar 50*c* is typically made from the same ferrous material as the core 44*c* and provides an additional mass to support the entire pickup magnet 34*c*. The backbar 50*c* also creates a backstop for the back block 70*c* to push up against which supports the back block 70*c* in its respective location. The backbar 50*c* has a cross-section perpendicular to the central axis 14*c* that is in a stepped shape and abutting the core 44*c* at the second end 48*c*. This shape reduces the weight of the backbar 50*c* as well as the amount of material used in its construction. The backbar 50*c* also helps to drive the magnetic field 38*c* perpendicular to the backbar 50*c* to improve the operating efficiency of the magnetic drum separator 10*c*.

As can be seen by comparing FIGS. 6, 7, and 8, the tapered shape of the incrementally stepped cross-section of the core 44*c* maximizes efficient use of the space within the physical limitations of the outer shell 12*c*. The block configuration of the core 44*c* allows the number of windings of the electrical wire 42*c* around each block to be maximized based on the amount of space available to each block individually. In general the shape of the core 44*c* will allow a greater number of windings than the rectangular core of the prior art. As explained above, the greater number of windings means that the resulting magnetic field 38*c* created by the core 44*c* pickup magnet 34*c* is more powerful than prior art pickup magnets. Moreover, because each block of the core is individually wound with its own electrical wire 42*c*, it is possible to have each block wound with electrical wire 42*c* having different diameters. This could further allow for more windings around specific blocks as needed without losing stability in the electrical wire 42*c* that could cause the electrical wire 42*c* to unravel.

The stepped core 44*c* permits the entire pickup magnet 34*c* to be closer to the inner circumference of the circular cross-section 18*c* without interfering with the positioning of the other components. With the first end 46*c* of the pickup magnet 34*c* closer to the inner circumference of the circular cross-section 18*c* of the magnetic field 38*c* generated by the pickup magnet 34*c* is that much closer (and therefore that much stronger) to the material stream 20*c* which leads to more efficient separation of ferrous 22*c* materials from the material stream 20*c*.

The larger size and location of the back block 70*c* relative to the other blocks of the pickup magnet 34*c* requires that more electrical wire 42*c* be wound around the back block 70*c* than the other two blocks. These additional windings ensure that the back block 70*c* adequately contributes to the generation of the magnetic field 38*c* generated by the pickup magnet 34*c*. More windings also ensures that the back block 70*c* produces a magnetic field 38*c* strong enough to extend from the surface of the outer shell 12*c* around the locations that are perpendicular to the pickup magnet 34*c*. Being fundamentally closer to the inner circumference of the circular cross-section 18*c*, the middle block 68*c* requires fewer windings to contribute to the generation of an adequate magnetic field 38*c*. The front block 66*c* requires even fewer windings than the middle block 68*c* and the back block 70*c*.

As shown in FIGS. 6, 7, 8 and 11, the carry magnets 36*c* are positioned at a fixed location within the outer shell, 12*c* near the inner circumference of the circular cross-section 18*c* and downstream of the pick up magnet 34*c* in the direction rotation of the outer shell 12*c*. The carry magnets 36*c* extend along the arc of the inner circumference of the circular cross-section 18*c* and are oriented so that the ferrous 22*c* material extracted from the material stream 20*c* by the pickup magnets 34*c* is held on to the outer shell 12*c* after the ferrous 22*c* material has rotated past the magnetic field 38*c* that is generated by the pickup magnet 34*c*. In the preferred embodiment, the carry magnets 36*c* are permanent magnets and comprise a number of rectangular permanent magnets that extend along the tubular length 16*c* of the magnetic drum separator 10*c*. The carry magnets 36*c* may be a single magnet, series of single magnets, or stacks of magnets arranged to form a desired configuration. However, one skilled in the art would recognize that any type of magnet or configuration of carry magnets 36*c* could be used to help hold ferrous 22*c* materials onto the outer shell 12*c* and carry it away from the material stream 20*c*. The permanent magnets of the carry magnets 36*c* may be ceramic, ferrite, or any other appropriate magnetic material. As can be seen in FIG. 6, the arrangement of the pickup magnet 34*c* relative to the carry magnets 36*c* in the preferred embodiment means that the magnetic field 38*c* generated by the pickup magnet 34*c* more readily overlaps with the magnetic field 40*c* generated by the carry magnets 36*c*. This means that the preferred embodiment does not have a drop zone as present in prior art embodiments.

A different embodiment of the magnetic drum separator 10*d* is shown in FIGS. 12, 12A, 13, and 14. In this embodiment a nosepiece 58*d* abuts the front block 66*d* at the first end 46*d* of the pickup magnet 34*d*. The nosepiece 58*d* comprises an unwrapped core element sized to span the tubular length 16*d* of the outer shell 12*d*. The nosepiece 58*d* helps extend the magnetic field 38*d* generated by the pickup magnet 34*d*.

Figure 12A:
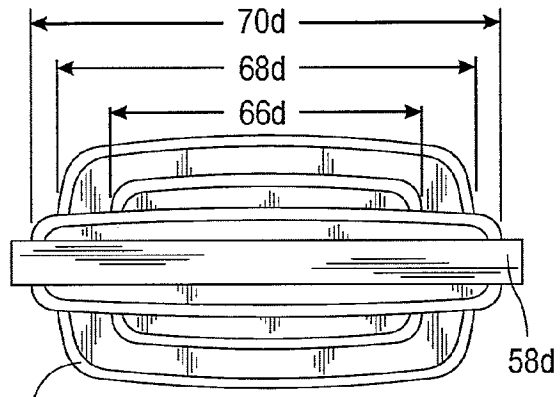
FIG. 12A is a forward facing view of the pickup magnet of FIG. 12.
Figure 12:
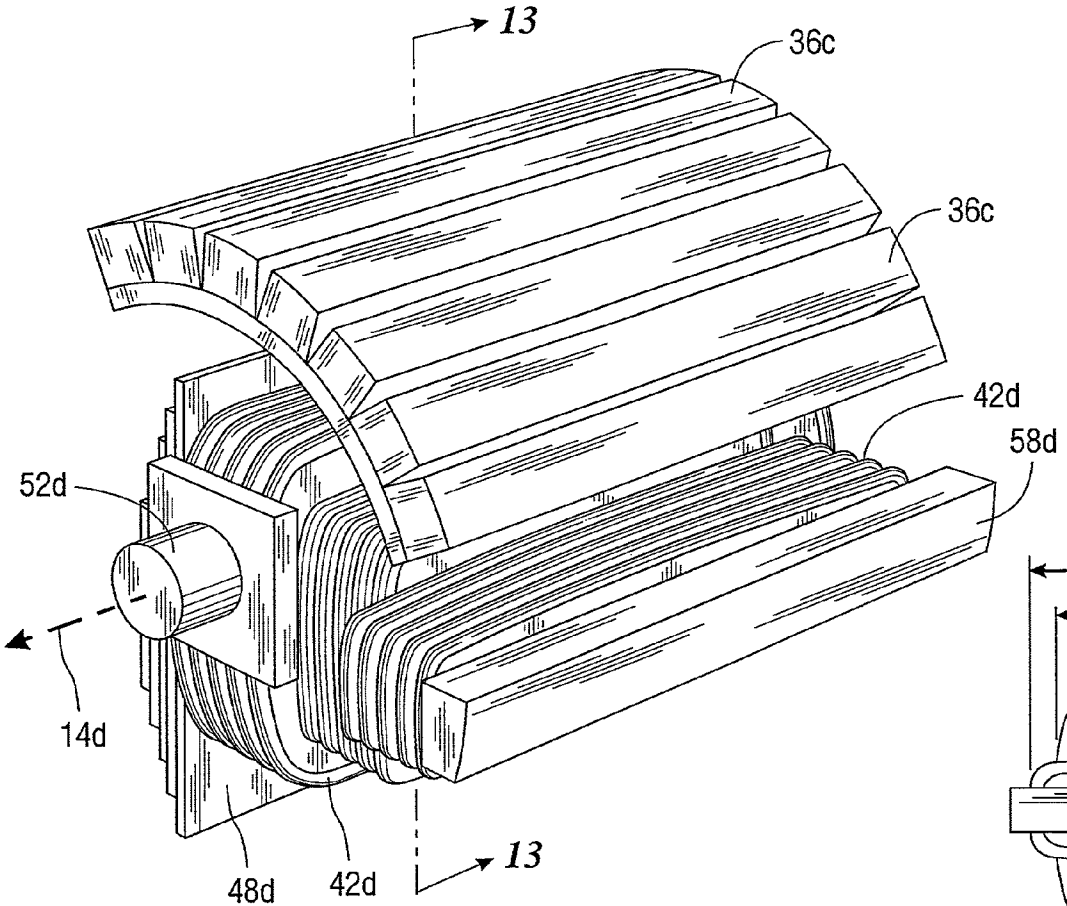
FIG. 12 is a perspective view of the inner mechanisms of an embodiment of the magnetic drum separator having an additional nosepiece element.
Figure 13:
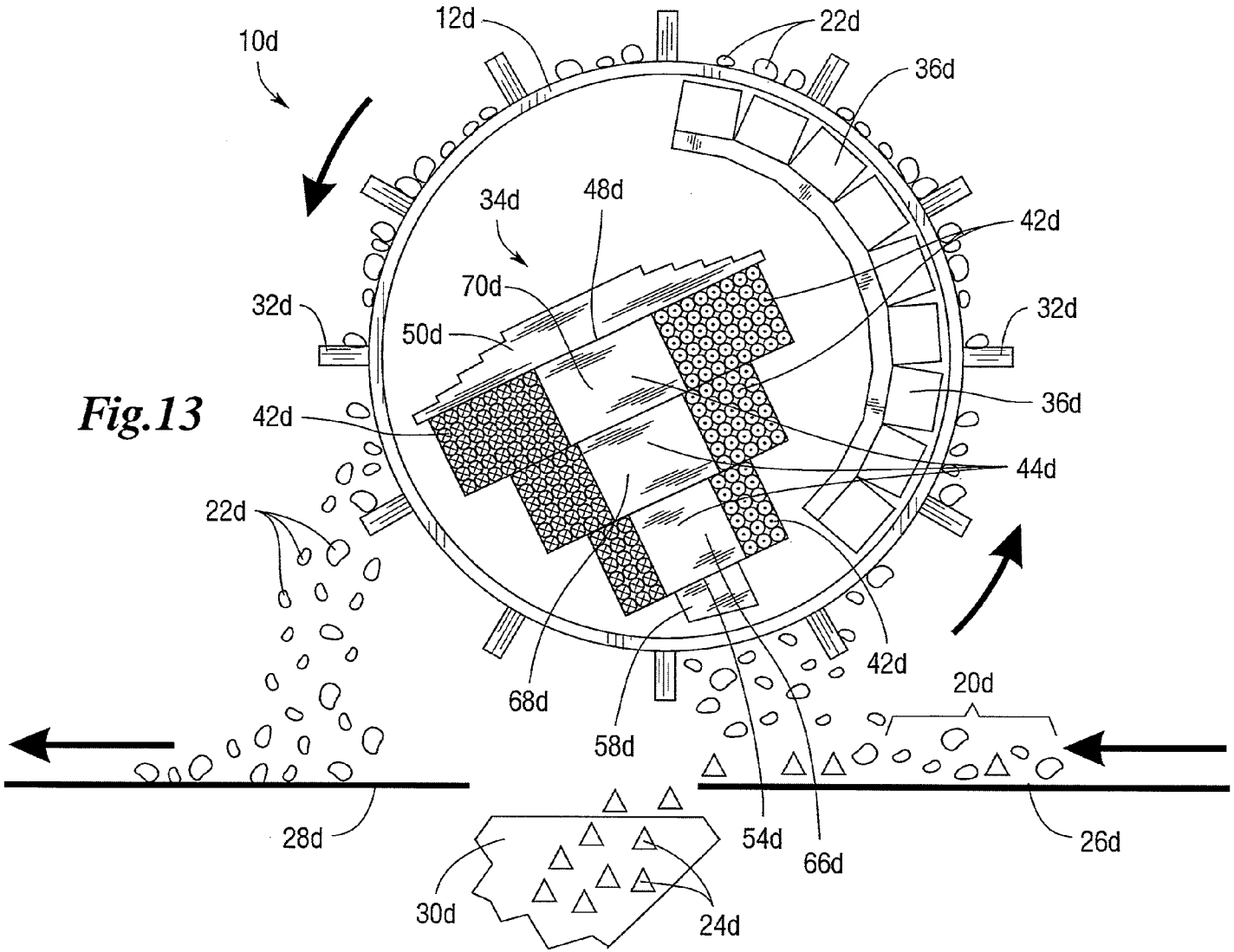
FIG. 13 is a cross-section of the magnetic drum separator of FIG. 12 in operation.
Figure 14:
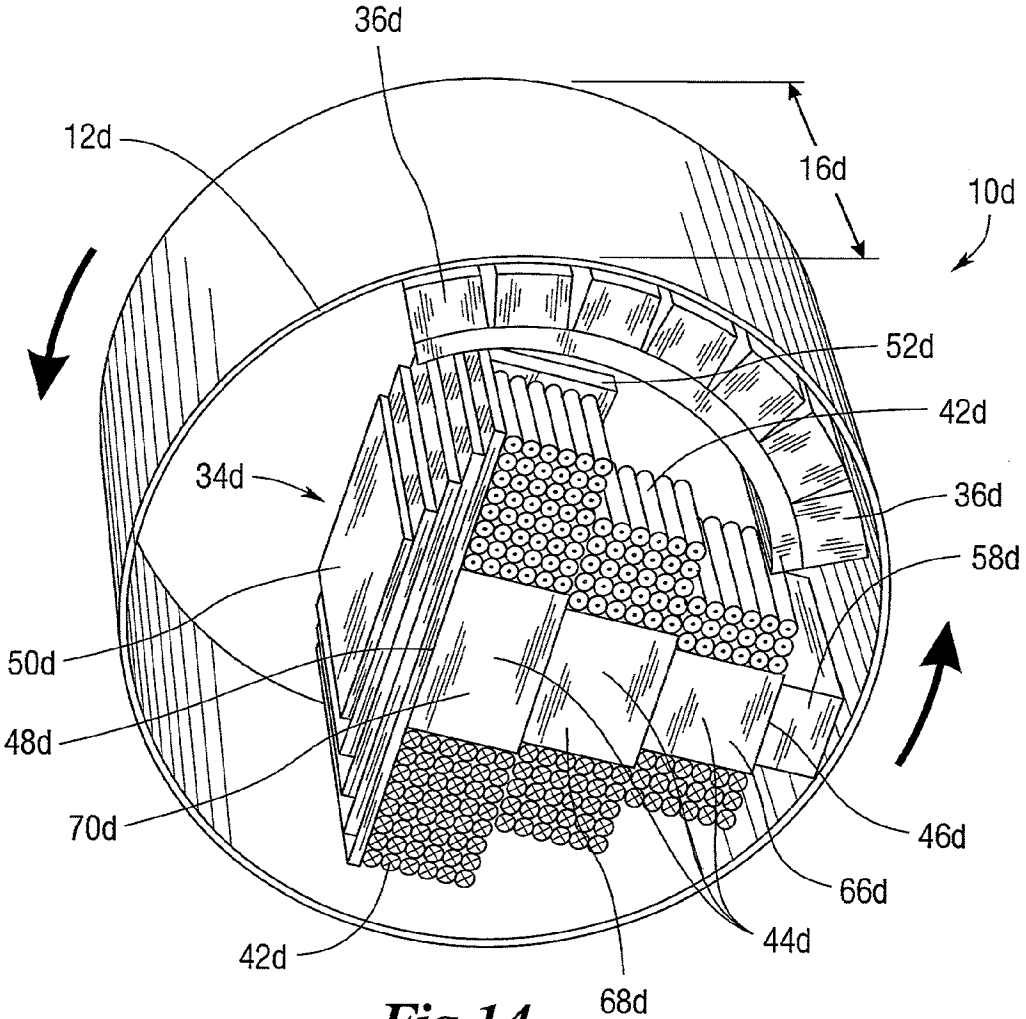
FIG. 14 is a perspective view of FIG. 13.

FIG. 12A shows the relative length of each block that comprises the core 44*a* in this embodiment relative to the nosepiece 58*d*. The length of the middle block 66*d* is shorter than both the length of the front block 64*d* and the length of the back block 68*d*. The back block 68*d* is the second shortest block because the length of the back block 70*d* is restricted by the space taken up by the pivot point 52*d*. The front block 66*d* spans almost the entire tubular length 14*d* of the outer shell 12*d* and the nosepiece 58*d* spans even further than the front block 66*d*. FIG. 12A also further illustrates the relative thickness of each of the front block 66*d*, the middle block 68*d*, and the back block 70*d* relative to each other and the nosepiece 58*d*. Because the nosepiece 58*d* is not wrapped with electrical wire 42*d*, it can be positioned even closer to the inner circumference of the circular cross-section 18*d* which pushes the magnetic field 38*d* of the pickup magnet 34*d* even further out from the outer shell 12*d*.

Figure 15:
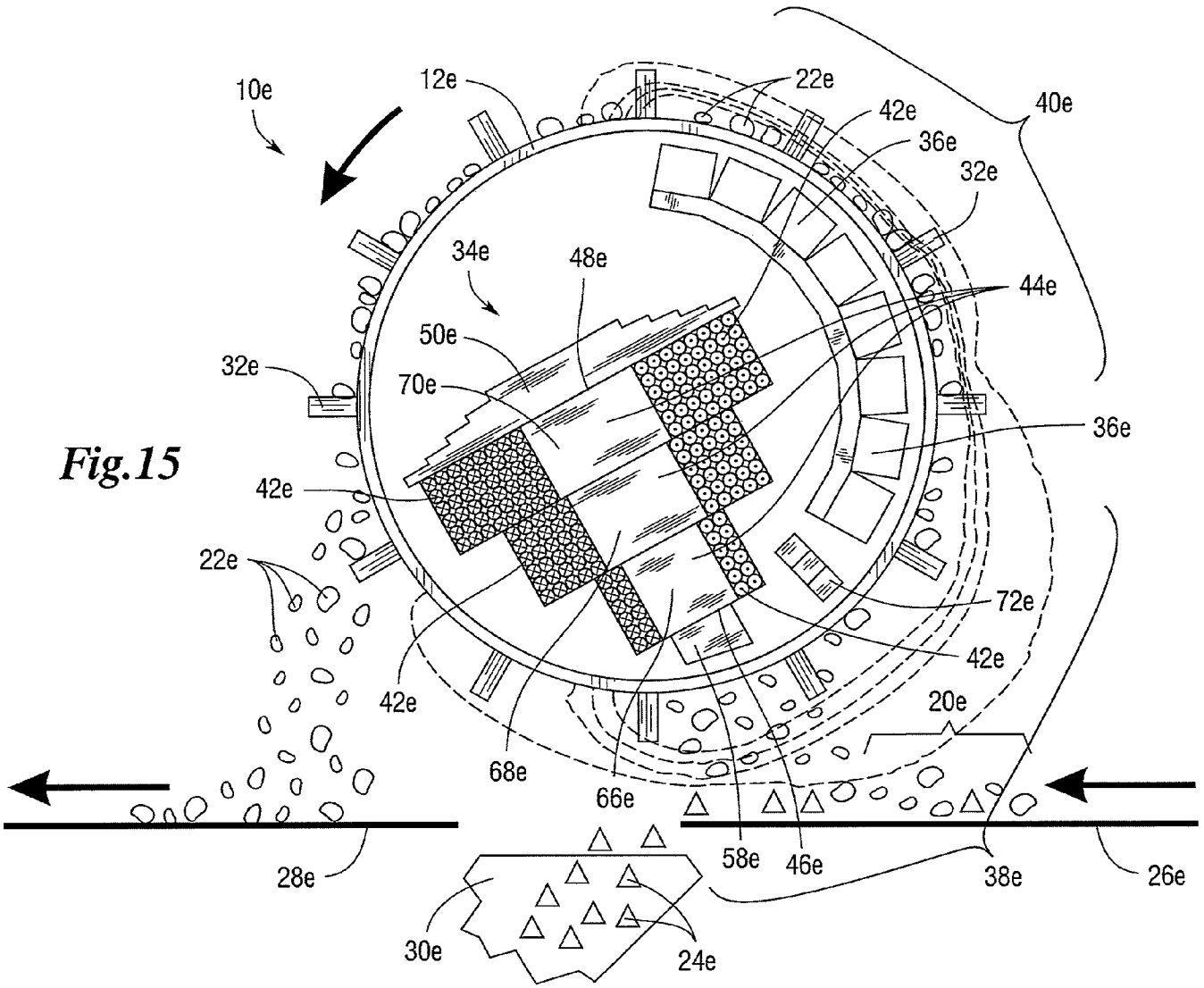
FIG. 15 is a cross-section of an embodiment of the magnetic drum separator having an additional interpole magnet in operation.

Another embodiment of the magnetic drum separator 10*e* is shown in FIG. 15, which incorporates an interpole magnet 72*e* (also known as a bucking magnet) positioned at a fixed location between the pickup magnet 34*e* and the carry magnets 36*e*. The interpole magnet 72*e* is an optional feature that typically comprises a permanent magnet sized to span the across the tubular length 16*e* of the magnetic drum separator 10*e* and is positioned along the inner circumference of the circular cross-section 18*e*. Typically interpole magnets 72*e* are used in larger diameter magnetic drum separators 10*e* to help bridge possible drop zone gaps between the magnetic field 38*e* generated by the pickup magnet 34*e* and the magnetic field 40*e* generated by the carry magnets 36*e*. This embodiment also includes a nosepiece 58*e*.

Figure 16:
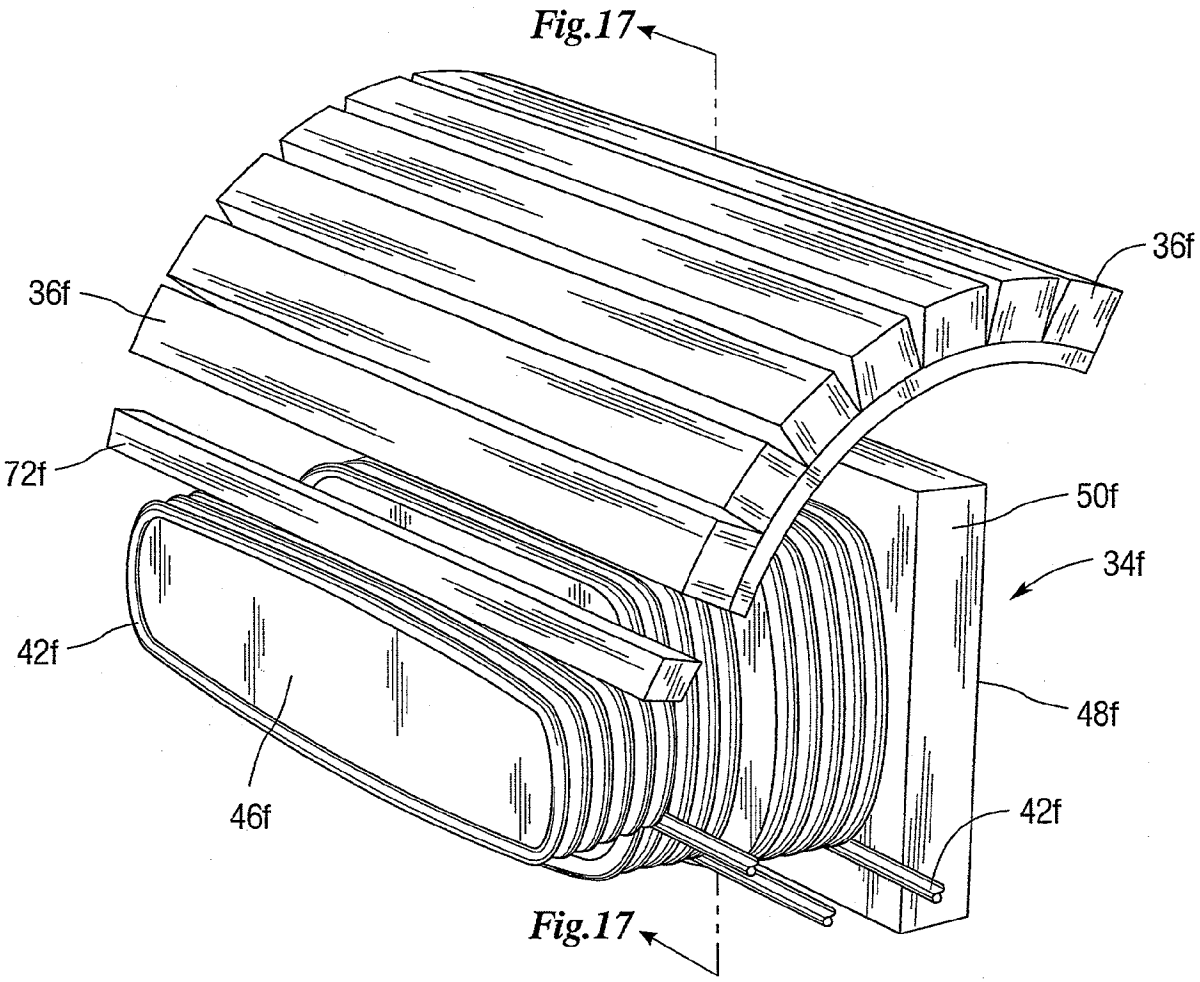
FIG. 16 depicts a perspective view of the inner mechanisms of an embodiment of the magnetic drum separator having an interpole magnet and a rectangular backbar.
Figure 17:
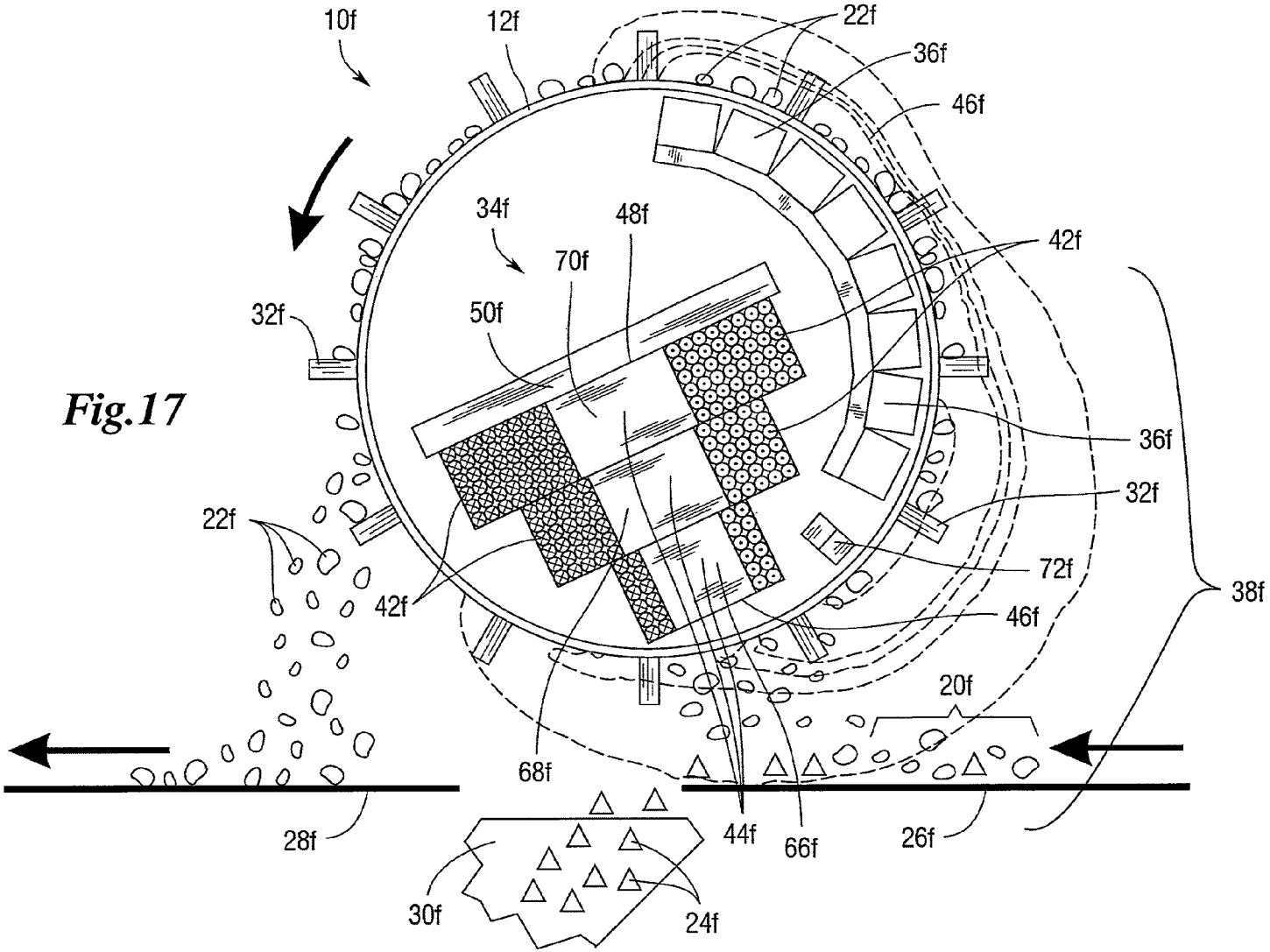
FIG. 17 is a cross-section of FIG. 16 in operation and showing a representation of the generated magnetic field.

As seen in the embodiment of the magnetic drum separator 10*f* shown in FIGS. 16 and 17, the magnetic drum separator 10*f* could not only incorporate an interpole magnet 72*f*, but also have a rectangular backbar 50*f* instead of the stepped backbar shown in earlier embodiments. Rectangular backbars 50*f* operate in substantially the same manner as the stepped backbar of the preferred embodiment, but the rectangular backbar 50*f* embodiment needs more material to manufacture and are, thus, correspondingly heavier than stepped backbars. Rectangular backbars 50*f* are less efficient in generating their portion of the magnetic field because of their shape. However rectangular backbars 50*f* are helpful when used in larger diameter magnetic drum separators 10*f* because they can support the weight of a much larger pickup magnet 34*f* than a pickup magnet used in smaller drum separators 10*f*. These rectangular backbars 50*f* may add weight and production costs to the magnetic drum separators 10*f*. It should be noted that there may be specific applications which require magnetic field configurations that call for rectangular backbars 50*f* as shown and that such situations are well understood by those skilled in the art.

Figure 18:
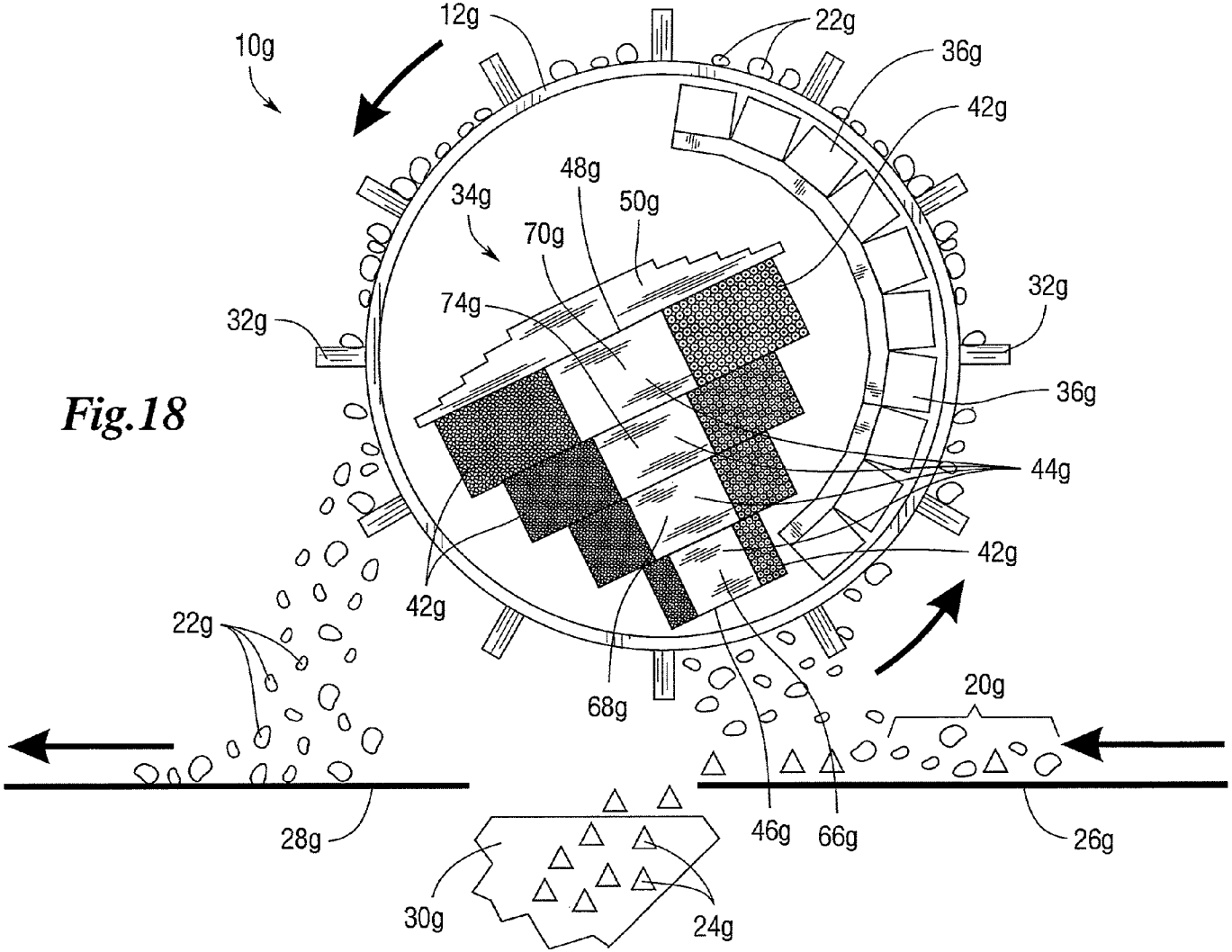
FIG. 18 is a cross-section of an embodiment of the magnetic drum separator in operation that has a core made of four blocks.

It will be understood that the actual number of blocks comprising the core of the pickup magnet need not be the three shown in the preferred embodiment. For example, in the embodiment shown in FIG. 18, the core 44*g* of the pickup magnet 34*g* has an incrementally stepped cross-section perpendicular to the central axis 14*g* in a tapered shape comprising four blocks: a front block 66*g*, a first middle block 68*g*, a second middle block 74*g*, and a back block 70*g*. The front block 62*g* is the narrowest of the four blocks and is located at the first end 46*g* of the pickup magnet 34*g*. The back block 70*g* is the widest of the four blocks and abutts the backbar 50*g*. Finally, the first middle block 68*g* and second middle block 74*g* are incremental in width between the front block 66*g* and the back block 70*g*.

Each of the blocks is an independent circuit that has electrical wire 42*g* wrapped around the block so that the electrical wire 42*g* only covers a single block and does not overlap any other block. The greater number of blocks creates more surface area for the wire to wrap around that further stabilizes the electrical wire 42*g* after it has been wrapped around the block and reduces the chances that the electrical wire 42*g* will come loose and unravel into the outer shell 12*g*. Thus, the electrical wire 42*g* used in this embodiment can have a much smaller diameter that may be too unstable for embodiments comprising fewer blocks.

This embodiment allows for the first end 46*g* of the pickup magnet 34*g* to be positioned even closer the inner circumference of the circular cross-section 18*g* than embodiments with fewer blocks. This allows the magnetic field 38*g* generated by the pickup magnet 34*g* (not shown) to extend further into the material stream 20*g*.

Figure 19:
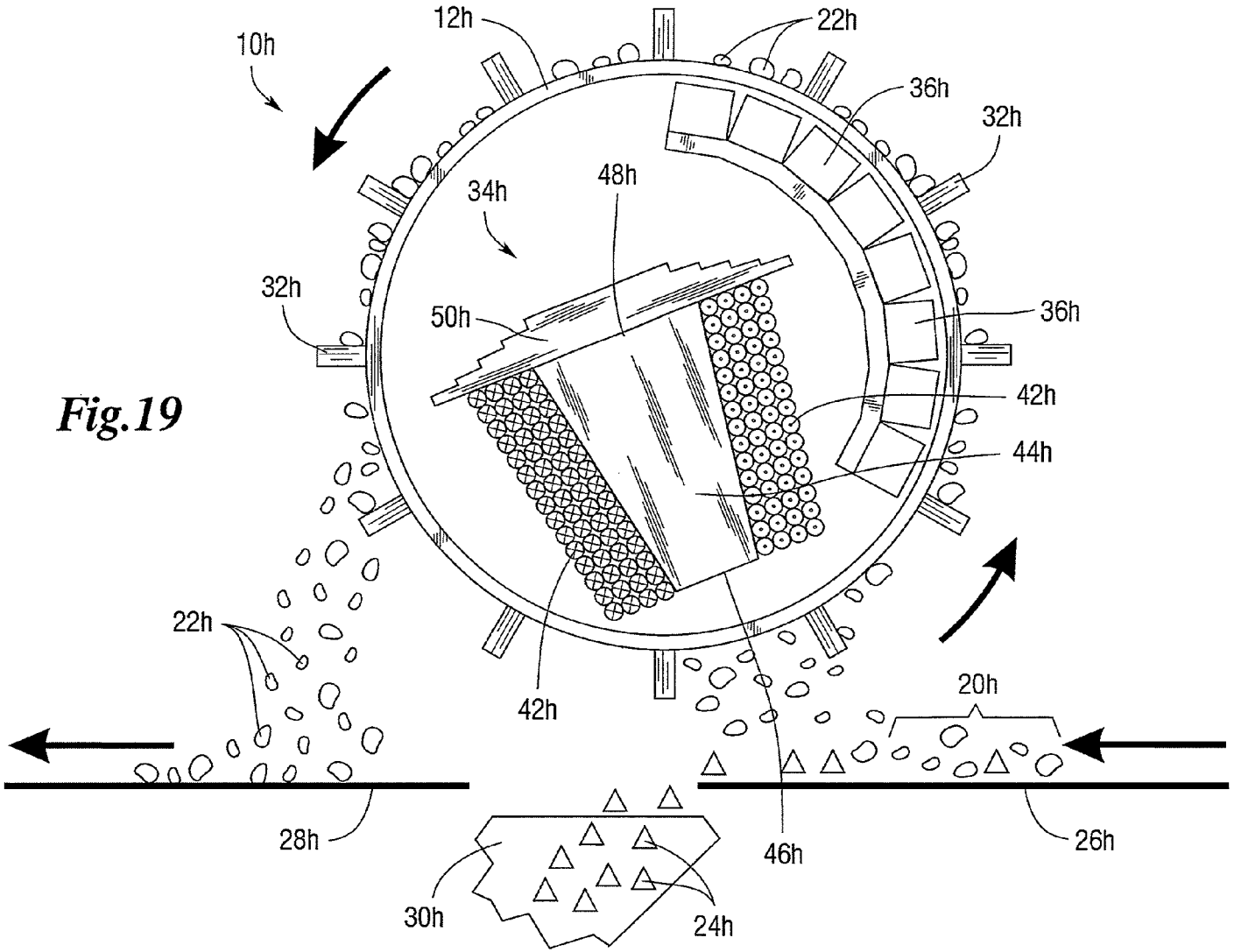
FIG. 19 is a cross-section of an embodiment of the magnetic drum separator having a core made of a single tapered block.

In another embodiment shown in FIG. 19, shows a magnetic drum separator 10*h* in which the core 44*a* of the pickup magnet 34*g* is a single block that has a cross-section that is in a tapered shape. The tapered shape of the core 44*h* is narrowest at the first end 46*h* of the pickup magnet 34*h* and gradually widens until the second end 48*h* where the core 44*h* abutts the backbar 50*h*.

As with the embodiments described earlier, the core 44*h* is wrapped with an electrical wire 42*h*. However, unlike the previous embodiments with stepped cores, to construct this embodiment of the magnetic drum separator 10*h*, the slope of the core 44*h* demands that the electrical wire 42*h* must be a larger diameter than that used in the preferred embodiment because the larger diameter electrical wire 42*h* has more surface area causing friction to make the wire more stable and less likely to slip from position and unravel within the outer shell 12*h*. Using larger electrical wire 42*h* means that there can be fewer windings around the core 44*h* than the preferred embodiment, so the pickup magnet 34*h* will necessarily generate a weaker magnetic field 38*h* (not shown).

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

What is claimed is:

1. A magnetic drum separator for the separation of ferrous and non-ferrous materials from a material stream comprising:

an outer shell that is rotatable around a central axis by a drive mechanism, said outer shell having a tubular length and a circular cross-section centered around said central axis;

said tubular length is parallel to said central axis and said circular cross-section is perpendicular to said central axis;

a pickup magnet that is an electromagnet positioned at a fixed location within said outer shell, extending along said tubular length, and having a cross-section perpendicular to said central axis in which a first end is closest to the inner circumference of said circular cross-section and a second end is located near said central axis;

said pickup magnet comprising a core, at least one electrical wire wrapped around said core, and a backbar abutting said core at said second end;

said core comprising a plurality of blocks, each block of different widths in a cross-section perpendicular to said central axis with the narrowest of said blocks at said first end and the widest of said blocks abutting said backbar such that said core has a cross-section perpendicular to said central axis that is an incrementally stepped tapered shape; and said pickup magnet powerful enough to produce a magnetic field suitable for separating ferrous materials from non-ferrous materials in the material stream.

2. The magnetic drum separator of claim 1 further comprising a carry magnet positioned at a fixed location within said outer shell, near the inner circumference of said circular cross-section, and downstream of said pick-up magnet in the direction of rotation of said outer shell.

3. The magnetic drum separator of claim 1 further comprising each of said blocks being wrapped by at least one electrical wire to form an independent circuit.

4. The magnetic drum separator of claim 1 further comprising an interpole magnet positioned at a fixed location between said pickup magnet and said carry magnet.

5. The magnetic drum separator of claim 1 in which said core has a cross-section perpendicular to said central axis that is in three step increments.

6. The magnetic drum separator of claim 1 in which said pickup magnet further comprises a nosepiece abutting said core at said first end.

7. The magnetic drum separator of claim 1 in which said core further comprises said backbar having a cross-section perpendicular to said central axis that is in a stepped shape.

8. A magnetic drum separator for the separation of ferrous and non-ferrous materials from a material stream comprising:

an outer shell that is rotatable around a central axis by a drive mechanism, said outer shell having a tubular length and a circular cross-section centered around said central axis;

said tubular length is parallel to said central axis and said circular cross-section is perpendicular to said central axis;

a pickup magnet that is an electromagnet positioned at a fixed location within said outer shell, extending along said tubular length, and having a cross-section perpendicular to said central axis in which a first end is closest to the inner circumference of said circular cross-section and a second end is located near said central axis;

said pickup magnet comprising a core, at least one electrical wire wrapped around said core, and a backbar abutting said core at said second end;

said core comprising a single block having a tapered cross-section perpendicular to said central axis that is narrowest at said first end and widest where said core abuts said backbar; and said pickup magnet powerful enough to produce a magnetic field suitable for separating ferrous materials from non-ferrous materials in the material stream.

9. The magnetic drum separator of claim 8 further comprising a carry magnet positioned at a fixed location within said outer shell, near the inner circumference of said circular cross-section, and downstream of said pick-up magnet in the direction of rotation of said outer shell.

10. The magnetic drum separator of claim 8 further comprising an interpole magnet positioned at a fixed location between said pickup magnet and said carry magnet.

11. The magnetic drum separator of claim 8 in which said pickup magnet further comprises a nosepiece abutting said core at said first end.

12. The magnetic drum separator of claim 8 in which said core further comprises said backbar having a cross-section perpendicular to said central axis that is in a stepped shape.

13. A magnetic drum separator for the separation of ferrous and non-ferrous materials from a material stream comprising:

an outer shell that is rotatable around a central axis by a drive mechanism, said outer shell having a tubular length and a circular cross-section centered around said central axis;

said tubular length is parallel to said central axis and said circular cross-section is perpendicular to said central axis;

a pickup magnet that is an electromagnet positioned at a fixed location within said outer shell, extending along said tubular length, and having a cross-section perpendicular to said central axis in which a first end is closest to the inner circumference of said circular cross-section and a second end is located near said central axis;

said pickup magnet comprising a core and a backbar;

said core comprising a front block, a middle block, and a back block, each said block of different widths in a cross-section perpendicular to said central axis, such that said core has a cross-section perpendicular to said central axis that is an incrementally stepped tapered shape and each said block of different lengths in the cross-section parallel to the central axis;

said front block is the narrowest of said blocks, located at said first end, and is longer than said back block;

said back block is the widest of said blocks, abuts against said backbar, and is longer than said middle block;

said pickup magnet powerful enough to produce a magnetic field suitable for separating ferrous materials from non-ferrous materials in the material stream.

14. The magnetic drum separator of claim 13 further comprising a carry magnet positioned at a fixed location within said outer shell, near the inner circumference of said circular cross-section, and downstream of said pick-up magnet in the direction of rotation of said outer shell.

15. The magnetic drum separator of claim 13 in which said pickup magnet further comprises a nosepiece abutting said front block.

16. The magnetic drum separator of claim 13 further comprising an interpole magnet positioned at a fixed location between said pickup magnet and said carry magnet.

17. The magnetic drum separator of claim 13 further comprising said front block, said middle block, and said back block each wrapped by an electrical wire to form their own independent circuit.

18. The magnetic drum separator of claim 13 in which said backbar has a cross-section perpendicular to said central axis that is in a stepped shape and abutting said core at said second end.

* * * * *